US009334729B2

(12) United States Patent
Indo et al.

(10) Patent No.: US 9,334,729 B2
(45) Date of Patent: May 10, 2016

(54) DETERMINING FLUID COMPOSITION DOWNHOLE FROM OPTICAL SPECTRA

(71) Applicants: Kentaro Indo, Sugar Land, TX (US); Kai Hsu, Sugar Land, TX (US); Julian Pop, Houston, TX (US)

(72) Inventors: Kentaro Indo, Sugar Land, TX (US); Kai Hsu, Sugar Land, TX (US); Julian Pop, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 722 days.

(21) Appl. No.: 13/644,772

(22) Filed: Oct. 4, 2012

(65) Prior Publication Data

US 2014/0096955 A1 Apr. 10, 2014

(51) Int. Cl.
*G01F 7/00* (2006.01)
*E21B 49/10* (2006.01)

(52) U.S. Cl.
CPC ..... *E21B 49/10* (2013.01)

(58) Field of Classification Search
CPC ..... E21B 49/088; G01N 21/255; G01V 8/12
See application file for complete search history.

(56) References Cited

U.S. PATENT DOCUMENTS

| | | | | |
|---|---|---|---|---|
| 5,329,595 | A * | 7/1994 | Davies | 382/103 |
| 6,031,619 | A * | 2/2000 | Wilkens et al. | 356/419 |
| 6,350,986 | B1 | 2/2002 | Mullins et al. | |
| 6,415,233 | B1 * | 7/2002 | Haaland | 702/22 |
| 6,738,502 | B1 * | 5/2004 | Coleman et al. | 382/133 |
| 7,336,356 | B2 | 2/2008 | Vannuffelen et al. | |
| 7,379,180 | B2 | 5/2008 | Vannuffelen et al. | |
| 7,428,925 | B2 | 9/2008 | Brown et al. | |
| 7,644,610 | B2 | 1/2010 | Meister | |
| 7,996,153 | B2 | 8/2011 | Niemeyer et al. | |
| 8,024,125 | B2 | 9/2011 | Hsu et al. | |
| 8,068,226 | B2 | 11/2011 | Csutak | |
| 8,146,415 | B2 | 4/2012 | Cartellieri | |
| 2003/0062472 | A1 | 4/2003 | Mullins et al. | |
| 2004/0233446 | A1 | 11/2004 | Dong et al. | |
| 2006/0155474 | A1 | 7/2006 | Venkataramanan et al. | |
| 2009/0030858 | A1 | 1/2009 | Hegeman et al. | |
| 2011/0048700 | A1 | 3/2011 | van Zuilekom et al. | |
| 2011/0087459 | A1 | 4/2011 | Zazovsky et al. | |
| 2011/0218736 | A1 | 9/2011 | Pelletier | |
| 2012/0018152 | A1 | 1/2012 | Zuilekom et al. | |

FOREIGN PATENT DOCUMENTS

WO WO2012108886 A1 8/2012

OTHER PUBLICATIONS

International Search Report and Written Opinion issued in PCT/US2013/063072 on Jan. 1, 2014, 11 pages.

(Continued)

*Primary Examiner* — Elias Desta
(74) *Attorney, Agent, or Firm* — Kenneth L. Kincaid

(57) ABSTRACT

Obtaining in-situ optical spectral data associated with a formation fluid flowing through a downhole formation fluid sampling apparatus, and predicting a parameter of the formation fluid flowing through the downhole formation fluid sampling apparatus based on projection of the obtained spectral data onto a matrix that corresponds to a predominant fluid type of the formation fluid.

20 Claims, 10 Drawing Sheets

(56) References Cited

OTHER PUBLICATIONS

Fujisawa, G.; Mullins, O.; Dong, C.; Carnegie, A.; Betancourt, S.; Terabayashi, T.; Yoshida, S.; Jaramillo, A. and Haggag, M., "Analyzing Reservoir Fluid Composition In-Situ in Real Time: Case Study in a Carbonate Reservoir", Society of Patroleum Engineers, SPE 84092, presented at the SPE Annual Technical Conference and Exhibition held in Denver, Colorado, U.S.A., Oct. 5-8, 2003, pp. 1-9.

Venkataramanan, L.; Elshahawi, H.; McKinney D.; Flannery, M. and Hashem, M., "Downhole Fluid Analysis and and Fluid Comparison Algorithm as an Aid to Reservoir Characterization", Society of Patroleum Engineers, SPE 100937, presented at the 2006 SPE Asia Pacific Oil & Gas Conference and Exhibition held in Adelaide, Australia, Sep. 11-13, 2006, pp. 1-16.

Dong, C.; O'Keefe, M.; Elshahawi, H.; Hashem, M.; Williams, S.; Stensland, D.; Hegeman, P.; Vasques, R; Terabayashi, T.; Mullins, O. and Donzier, E., "New Downhole-Fluid-Analysis Tool for Improved Reservoir Characterization", Society of Patroleum Engineers, SPE 108566, presented at Offshore Europe, Aberdeen, Sep. 4-7, 2008, pp. 1107-1116.

European Search Report issued in related EP application 13843626 on Mar. 24, 2016, 4 pages.

* cited by examiner

DETERMINING FLUID COMPOSITION DOWNHOLE FROM OPTICAL SPECTRA

BACKGROUND OF THE DISCLOSURE

Downhole fluid analysis (DFA) is often used to provide information in real time about the composition of subterranean formations or reservoir fluids. Such real-tune information can be advantageously used to improve or optimize the effectiveness of formation testing tools during a sampling processes in a given well, including sampling processes which don't return a captured formation fluid sample to the Earth's surface. For example, DFA allows for reducing and/or optimizing the number of samples captured and brought back to the surface for further analysis. Some known downhole fluid analysis tools such as the Live Fluid Analyzer (LFA) and the Composition Fluid Analyzer (CFA), both of which are commercially available from Schlumberger Technology Corporation, can measure absorption spectra of formation fluids under downhole conditions. Each of these known fluid analyzers provides ten channels, each of which corresponds to a different wavelength of light that corresponds to a measured spectrum ranging from visible to near infrared wavelengths. The output of each channel represents an optical density (i.e., the logarithm of the ratio of incident light intensity to transmitted light intensity), where an optical density (OD) of zero (0) corresponds to 100% light transmission, and an OD of one (1) corresponds to 10% light transmission. The combined OD output of the channels provides spectral information that can be used to determine the composition and various other parameters of formation fluids.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
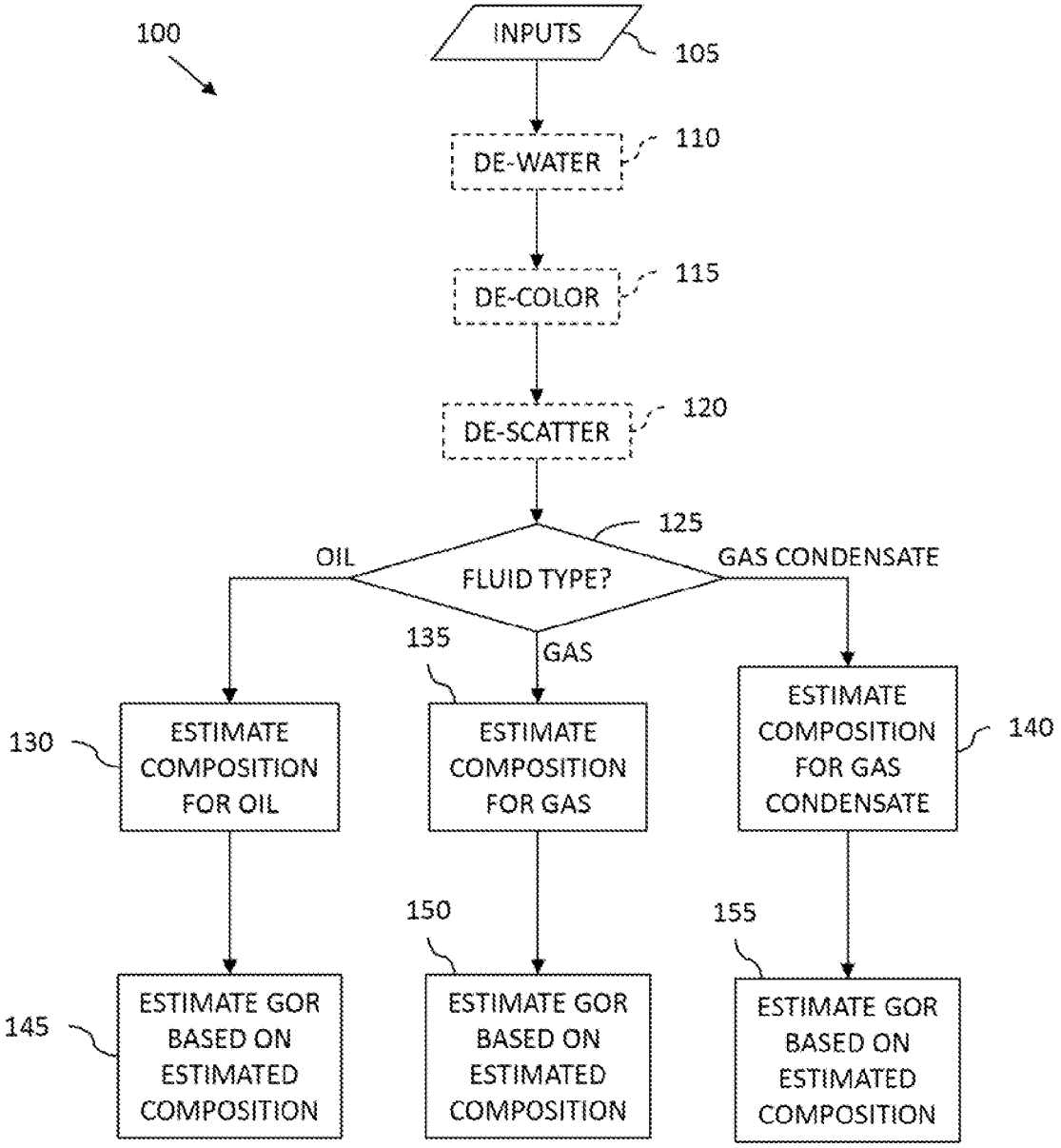
FIG. 1 is a flow-chart diagram of at least a portion of a method according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed except where specifically noted as indicating a relationship. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The CFA was one of the first tools utilized for downhole fluid analysis (DFA), performing downhole compositional analysis of hydrocarbon mixtures. Still in use today, the CFA utilizes an optical spectrometer having seven near-infrared (NIR) channels to estimate partial density of the carbon species in gas and gas condensate. The equation of the CFA algorithm is set forth below as equation (1):

$$y=xB \tag{1}$$

where x denotes CFA optical densities (OD) at seven channels, y denotes estimated partial densities of carbon species, and B is a mapping matrix calibrated against an optical spectrum database by using a principal component regression (PCR).

More recently developed downhole tools for performing DFA utilize an optical spectrometer having 36 channels. The evolution towards greater numbers of spectrometer channels has given rise to sequential methods for composition computation, employing algorithms optimized for oil as well as gas and gas condensate. The present disclosure, however, introduces aspects in the context of a downhole tool having a 20-channel spectrometer. Nonetheless, such aspects are applicable or readily adaptable for use with DFA employing a 36-channel spectrometer and/or another spectrometer having any number of channels.

According to Beer-Lambert's law, optical density (absorption) is proportional to an absorption coefficient $\alpha$, concentration (or partial density) $\rho$ and optical pathlength l, as set forth in equation (2) below:

$$\mathrm{OD}(\lambda)=\alpha(\lambda)\cdot\rho\cdot l \tag{2}$$

where $\lambda$ denotes wavelength of an electro-magnetic wave, particularly UV-visible-NIR light, mid-IR light and/or others.

Optical density of multi-component systems can be described as a linear combination of contributions from individual carbon components (e.g., C1, C2, C3, C4, C5, C6+ and CO2) if there is no significant interaction between components, as set forth below in equation (3):

$$\begin{aligned} OD(\lambda) &= \sum_i OD_i = OD_{C1}(\lambda) + OD_{C2}(\lambda) + OD_{C3}(\lambda) + \\ &\quad OD_{C4}(\lambda) + OD_{C5}(\lambda) + OD_{C6+}(\lambda) + OD_{CO2}(\lambda) \\ &= \alpha_{C1}\cdot\rho_{C1}\cdot l + \alpha_{C2}\cdot\rho_{C2}\cdot l + \alpha_{C3}\cdot\rho_{C3}\cdot l + \alpha_{C4}\cdot\rho_{C4}\cdot l + \\ &\quad \alpha_{C5}\cdot\rho_{C5}\cdot l + \alpha_{C6+}\cdot\rho_{C6+}\cdot l + \alpha_{CO2}\cdot\rho_{CO2}\cdot l \end{aligned} \tag{3}$$

Equation (3) can be altered to a concentration-independent form as follows. To start, the relationship between weight fraction ($\omega_i$) and concentration (or partial density) is set forth below in equation (4):

$$(\omega_{C1}, \omega_{C2}, \omega_{C3}, \omega_{C4}, \omega_{C5}, \omega_{C6}, \omega_{CO2}) = \left(\frac{\rho_{C1}}{\rho_{total}}, \frac{\rho_{C2}}{\rho_{total}}, \ldots, \frac{\rho_{CO2}}{\rho_{total}}\right) \quad (4)$$

where total density is given by $\rho_{total}=\Sigma_i\rho_i$ (i=C1, C2, C3, C4, C5, C6+ and CO2).

Normalizing by weight fraction of a particular component, ($\omega_C$) (C=C1, C2, C3, C4, C5, C6+ or CO2), results in equation (5) set forth below:

$$\begin{aligned}\left(\frac{\omega_{C1}}{\omega_C}, \frac{\omega_{C2}}{\omega_C}, \ldots, \frac{\omega_{CO2}}{\omega_C}\right) &= \left(\frac{\omega_{C1}\rho_{total}}{\omega_C\rho_{total}}, \frac{\omega_{C2}\rho_{total}}{\omega_C\rho_{total}}, \ldots, \frac{\omega_{CO2}\rho_{total}}{\omega_C\rho_{total}}\right) \\ &= \left(\frac{\rho_{C1}}{\rho_C}, \frac{\rho_{C2}}{\rho_C}, \ldots, \frac{\rho_{CO2}}{\rho_C}\right) \\ &= (\bar{\rho}_{C1}, \bar{\rho}_{C2}, \bar{\rho}_{C3}, \bar{\rho}_{C4}, \bar{\rho}_{C5}, \bar{\rho}_{C6+}, \bar{\rho}_{CO2})\end{aligned} \quad (5)$$

where $\omega_i\rho_{total}=\rho_i$ and $\bar{\rho}_i=\rho_i/\rho_C$ describe the relative concentration to the concentration of a component C (i=C1, C2, C3, C4, C5, C6+ or CO2).

Equation (3) may also be altered if $OD_C(\lambda')$ is non-zero, as set forth in Equation (6) below:

$$\begin{aligned}OD(\lambda) &= \sum_i OD_i(\lambda) \\ &= OD_c(\lambda')\sum_i \frac{OD_i(\lambda)}{OD_C(\lambda')} \\ &= OD_C(\lambda')\sum_i \frac{\alpha_i(\lambda)\cdot\rho_i\cdot l}{\alpha_C(\lambda')\cdot\rho_C\cdot l} \\ &= OD_C(\lambda')\cdot\sum_i \bar{\alpha}_i(\lambda)\cdot\bar{\rho}_i\end{aligned} \quad (6)$$

where $\bar{\alpha}_i(\lambda)=\alpha_i(\lambda)/\alpha_C(\lambda')$ is the relative absorption coefficient of $\alpha(\lambda)$ to $\alpha_C(\lambda')$, and where $\bar{\rho}=\rho_i/\rho_C$ is the relative concentration of $\rho_i$ to $\rho_C$.

Thus, the normalized optical density by optical density of a component C at wavelength λ' can be expressed as set forth below in equation (7):

$$\overline{OD}(\lambda) = \frac{OD(\lambda)}{OD_C(\lambda')} = \sum_i \bar{\alpha}_i(\lambda)\cdot\bar{\rho}_i \quad (7)$$

$$(i = C1, C2, C3, C4, C5, C6+ \text{and CO2})$$

Equation (7) is temperature, pressure and pathlength independent because the variation of the absorption coefficient $\alpha(\lambda)$ against temperature and pressure is nearly constant. For gas and gas condensate samples: C=C1 and λ' 1650 nm may be used, resulting in equation (8) set forth below:

$$\overline{OD}_{gas}(\lambda) = \frac{OD(\lambda)}{OD_{C1}(1650\text{ nm})} = \bar{\alpha}_{C1}(\lambda) + \bar{\alpha}_{C2}(\lambda)\cdot\bar{\rho}_{C2} + \bar{\alpha}_{C3}(\lambda)\cdot\bar{\rho}_{C3} + \bar{\alpha}_{C4}(\lambda)\cdot\bar{\rho}_{C4} + \bar{\alpha}_{C5}(\lambda)\cdot\bar{\rho}_{C5} + \bar{\alpha}_{C6+}(\lambda)\cdot\bar{\rho}_{C6+} + \bar{\alpha}_{CO2}(\lambda)\cdot\bar{\rho}_{CO2} \quad (8)$$

where $\bar{\rho}_{C1}=\rho_{C1}/\rho_C=1$ and $\bar{\alpha}_i(\lambda)=\alpha_i(\lambda)/\alpha_{C1}(1650\text{ nm})$.

In a similar way, C=C6+ and λ'=1725 nm may be used for oil samples, resulting in equation (9) set forth below:

$$\overline{OD}_{oil}(\lambda) = \frac{OD(\lambda)}{OD_{C6+}(1725\text{ nm})} = \bar{\alpha}_{C1}(\lambda)\cdot\bar{\rho}_{C1} + \bar{\alpha}_{C2}(\lambda)\cdot\bar{\rho}_{C2} + \bar{\alpha}_{C3}(\lambda)\cdot\bar{\rho}_{C3} + \bar{\alpha}_{C4}(\lambda)\cdot\bar{\rho}_{C4} + \bar{\alpha}_{C5}(\lambda)\cdot\bar{\rho}_{C5} + \bar{\alpha}_{C6+}(\lambda) + \bar{\alpha}_{CO2}(\lambda)\cdot\bar{\rho}_{CO2} \quad (9)$$

where $\bar{\rho}_{C6+}=\rho_{C6+}/\rho_C=1$ and $\bar{\alpha}_i(\lambda)=\alpha_i(\lambda)/\alpha_{C6+}(1725\text{ nm})$.

In equations (8) and (9), however, $OD_C(\lambda')$ is an unknown variable at this point in the analysis. From equation (7):

$$OD_C(\lambda') = \frac{OD(\lambda)}{\sum_i \bar{\alpha}_i(\lambda)\cdot\bar{\rho}_i} \quad (10)$$

For gas and gas condensate spectra, λ'=λ=1650 nm may be chosen, and terms of C3, C4, C5, C6+ and CO2 can be truncated from equation (10) because contributions from these terms at 1650 nm is negligible, thus resulting in equation (11) set forth below:

$$OD_{C1}(1650\text{ nm}) = \frac{OD(1650\text{ nm})}{1 + \bar{\alpha}_{C2}(1650\text{ nm})\cdot\bar{\rho}_{C2}} \quad (11)$$

Likewise for oil spectra, λ'=λ=1725 nm may be chosen, and terms of C1, C2 and CO2 can be truncated, thus resulting in equation (12) set forth below:

$$OD_{C6+}(1725\text{ nm}) = \frac{OD(1725\text{ nm})}{\bar{\alpha}_{C3}(1725\text{ nm})\cdot\bar{\rho}_{C3} + \bar{\alpha}_{C4}(1725\text{ nm})\cdot\bar{\rho}_{C4} + \bar{\alpha}_{C5}(1725\text{ nm})\cdot\bar{\rho}_{C5} + 1} \quad (12)$$

The color spectrum can also be taken into account for oil spectra cases. That is, since there is less vibrational absorption from C1, C2, C3, C4, C5, C6+ and CO2 at 1500 nm, optical density a 1500 nm originates primarily from color (if there is any). Thus, color absorption at 1725 nm can be described, as proportional to optical density at 1500 nm, as set forth below in equation (13):

$$OD_{Color}(1725\text{ nm})=\beta\cdot OD(1500\text{ nm}) \quad (13)$$

Alternatively, the $OD_{Color}$(1725 nm) may be expressed as set forth below in equation (13'):

$$OD_{Color}(1725\text{ nm})=\beta\exp^{(\alpha 1725\text{ nm})}+\gamma \quad (13')$$

where β, α and γ are adjustable parameters determined in a manner similar to β in equation (13). Moreover, the analysis that follows may be applicable or readily adaptable for instances where equation (13') is utilized as an alternative to equation (13).

Combining equations (12) and (11) results in equation (14) set forth below:

$$OD_{C6+}(1725\text{ nm}) = \frac{OD(1725\text{ nm})}{\bar{\alpha}_{C3}(1725\text{ nm})\cdot\bar{\rho}_{C3} + \bar{\alpha}_{C4}(1725\text{ nm})\cdot\bar{\rho}_{C4} + \bar{\alpha}_{C5}(1725\text{ nm})\cdot\bar{\rho}_{C5} + 1 + \beta\cdot OD(1500\text{nm})} \quad (14)$$

Thus, the linear relationship between normalized optical density and relative concentration for gas and gas condensate samples may be as set forth below in equations (15) and (16):

$$\overline{OD}_{gas}(\lambda) = \frac{OD(\lambda)}{OD_{C1}(1650\text{ nm})} = \overline{\alpha}_{C1}(\lambda) + \overline{\alpha}_{C2}(\lambda)\cdot\overline{\rho}_{C2} + \overline{\alpha}_{C3}(\lambda)\cdot\overline{\rho}_{C3} + \overline{\alpha}_{C4}(\lambda)\cdot\overline{\rho}_{C4} + \overline{\alpha}_{C5}(\lambda)\cdot\overline{\rho}_{C5} + \overline{\alpha}_{C6+}(\lambda)\cdot\overline{\rho}_{C6+} + \overline{\alpha}_{CO2}(\lambda)\cdot\overline{\rho}_{CO2} \tag{15}$$

$$OD_{C1}(1650\text{ nm}) = \frac{OD(1650\text{ nm})}{1 + \overline{\alpha}_{C2}(1650\text{ nm})\cdot\overline{\rho}_{C2}} = \frac{1}{\eta_{C1}} \tag{16}$$

Similarly, the linear relationship between normalized optical density and relative concentration for oil samples may be as set forth below in equations (17) and (18):

$$\overline{OD}_{oil}(\lambda) = \frac{OD(\lambda)}{OD_{C6+}(1725\text{ nm})} = \overline{\alpha}_{C1}(\lambda)\cdot\overline{\rho}_{C1} + \overline{\alpha}_{C2}(\lambda)\cdot\overline{\rho}_{C2} + \overline{\alpha}_{C3}(\lambda)\cdot\overline{\rho}_{C3} + \overline{\alpha}_{C4}(\lambda)\cdot\overline{\rho}_{C4} + \overline{\alpha}_{C5}(\lambda)\cdot\overline{\rho}_{C5} + \overline{\alpha}_{C6+}(\lambda) + \overline{\alpha}_{CO2}(\lambda)\cdot\overline{\rho}_{CO2} \tag{17}$$

$$OD_{C6+}(1725\text{ nm}) = \frac{OD(1725\text{ nm})}{\overline{\alpha}_{C3}(1725\text{ nm})\cdot\overline{\rho}_{C3} + \overline{\alpha}_{C4}(1725\text{ nm})\cdot\overline{\rho}_{C4} + \overline{\alpha}_{C5}(1725\text{ nm})\cdot\overline{\rho}_{C5} + 1 + \beta\cdot OD(1500\text{ nm})} = \frac{1}{\eta_{C6+}} \tag{18}$$

where $\overline{\rho}_i = \rho_i/\rho_C = \omega_i/\omega_C$.

These linear relationships may be utilized within a method of mapping matrix calibration according to one or more aspects of the present disclosure, as described below.

Measured optical density is often affected by light scattering and offset due to refractive index, as well as absorption by the sample in the flowline of the downhole tool. For example, light scattering may be caused by particles (e.g., mud, sand, etc.), bubbles, water droplets and organic matter (e.g., asphaltenes) that may precipitate in the flowline. Dirty or coated optical windows may also cause light scattering. If the size of the scattering object is much larger than the wavelength of light, then the scattering effect is less wavelength-dependent (geometric scattering). If the size of the scattering object is comparable or smaller than the wavelength of light, then the resulting, scattering effects may be more wavelength-dependent (Mie/Rayleigh scattering).

With regard to a refractive index effect, if the spectrometer baseline is calibrated with air in the flowline of the downhole tool, then the zero optical density is defined in the air, with reflectivity at the boundaries between sapphire and air. The reflectivity at the boundaries depends on the refractive index of the fluid in the flowline. This effect appears as being a nearly constant negative offset on a spectrum.

To reduce these scattering and refractive index effects, the measured optical spectra may be aligned (e.g., shifted vertically), and optical density at a predetermined wavelength (e.g., 1600 nm) may be forced to zero. Of course, methods within the scope of the present disclosure may utilize additional and/or alternative forms of pretreating the measured optical spectrum.

The DFA and associated methods within the scope of the present disclosure may utilize mapping matrices B that are calibrated separately for gas, gas condensate and oil. The normalized optical spectrum data set resulting from the above analysis may be utilized as a set of calibrants in a partial least squares (PLS) process. There are, however, unknowns in the normalization term, such as $\overline{\alpha}_{C2}(1650\text{ nm})$ in equation (16) and $\{\overline{\alpha}_{C3}(1725\text{ nm})+\overline{\alpha}_{C4}(1725\text{ nm})+\overline{\alpha}_{C5}(1725\text{ nm})\}$ and $\beta$ in equation (18). These unknown parameters may be optimized so that a mapping matrix obtained from a PLS calibration may yield minimal composition errors. Errors of compositions (C1, C2, C3, C4, C5, C6+ and CO2) to be minimized by the optimization may be defined as set forth below in equation (19):

$$e_w = \frac{1}{N}\sqrt{\sum_j\sum_k (w'_{jk} - w_{jk})^2} \tag{19}$$

$$(k\text{: } C1, C2, C3, C4, C5, C6+\text{ and CO2})$$

where N denotes the number of samples, $w_{jk}$ represents the reference weight fraction of component k for sample j, and $w_{jk}'$ represents the predicted weight fraction of component k for sample j.

Laboratory-measured optical spectra employed for the PLS calibration may be converted into an equivalent channel spectra, since measurement parameters of the laboratory spectrometer and the downhole tool spectrometer may have significant differences. For example, the lab-measured data may be converted into an equivalent 20-channel spectra. Optical density adjustments may also be made to account fir noise and any hardware dependency from unit to unit. Such adjustments, which may include intentionally adding noise, may reduce the weight on error-sensitive channels in constructing the mapping matrices B. Consequently, the mapping may be more robust against effects of the hardware dependency or noise.

The mapping matrices B are calibrated by the mapping set forth below in equation (20).

$$\begin{Bmatrix} X \\ X + \delta X_1 \\ \vdots \\ X + \delta X_N \end{Bmatrix} B = \begin{Bmatrix} Y \\ Y \\ Y \\ Y \end{Bmatrix} \tag{20}$$

wherein X is the spectral dataset, δX is OD error (e.g., known from knowledge of the instrument), Y is relative concentration of components C1, C2, C3, C4, C5, C6+ and CO2, and N is the number of sets of adjusted spectral datasets that may be employed to calibrate the mapping matrix, forcing X+δX to be mapped to Y. Here, the mapping matrices B may be determined via PLS. However, other methods are also within the scope of the present disclosure, such as PCR, multiple regression, independent component analysis (ICA), and/or other methods for determining coefficients which map known inputs to known outputs.

As mentioned above, three different mapping matrices are required, one each for oil, gas and gas condensate, prior to composition analysis. To identify the fluid types from a spectrum, projections onto loading vectors obtained individually from oil, gas and gas condensate spectra in the database are performed. For example, the database spectra may be vertically aligned at a predetermined wavelength (e.g., 1600 nm), and channels around the hydrocarbon absorption peaks (e.g., from 1500 nm to 1800 nm) may be used. Each spectrum may then be normalized by summation over available spectral data points (e.g., 1500 nm-1800 nm), as set forth below in equation (23).

$$x = (OD - OD(1600\text{ nm})) \Big/ \sum_{\lambda=1500\text{ nm}}^{1800\text{ nm}} (OD(\lambda) - OD(1600\text{ nm})) \tag{23}$$

Loading vectors may then be obtained using, for example, singular value decomposition (SVD) or other forms of principal component analysis (PCA) on the database of each fluid type, as set forth below in equation (24):

$$X_i = U_i \Lambda_i V_i^T \ (i\text{=oil, gas, gas condensate}) \tag{24}$$

where U denotes the scores of X, Λ denotes eigenvalues of X, and V denotes loading matrices of X. Projection $p_i$ of a spectrum x onto the loading vector $V_i$ may then be acquired as set forth below in equation (25):

$$p_i = x \cdot V_i \tag{25}$$

Upon examining normalized eigenvalues of the spectrum database of oil, gas and gas condensate, it is noted that the eigenvalues of the first and second principal components dominate more than 90% of the total eigenvalues/contributions. Thus, the first two components may be deemed essential to describe spectra. Accordingly, projections onto the first two loading vectors of oil, gas and gas condensate may be evaluated as set forth below in equation (26):

$$p_{i1\&2} = \sqrt{p_{i1}^2 + p_{i2}^2} \tag{26}$$

The resulting $p_{i1\&2}$ may then be compared to determine the predominant fluid type. For example, the largest of the resulting $p_{i1\&2}$ may be considered to best represent the spectral shape for each of the three fluid types independently.

Once the mapping matrices are obtained, the calibration process described above is not required for performing the composition analysis. For the mapping matrix calibration using the PLS regression, all of the spectra used for the calibration were normalized using equation (16) or (18). Nonetheless, the unknown parameters ($\bar{\alpha}_{C2}$, $\bar{\alpha}_{C3}$, $\bar{\alpha}_{C4}$, $\bar{\alpha}_{C5}$, β) are optimized, and relative concentrations ($\bar{\rho}_{C2}$, $\bar{\rho}_{C3}$, $\bar{\rho}_{C4}$, $\bar{\rho}_{C5}$) in the normalization factor may be obtained from the database that was used for the calibration. Then, composition prediction for an unknown spectrum (OD) can be expressed using an unknown normalization factor η as set forth below in equation 27):

$$\eta \text{OD} \times B = \eta(\bar{\rho}_{C1}, \bar{\rho}_{C2}, \bar{\rho}_{C3}, \bar{\rho}_{C4}, \bar{\rho}_{C5}, \bar{\rho}_{C6+}, \bar{\rho}_{CO2}) \tag{27}$$

The normalization factor η may then be disregarded when the weight fraction is calculated from relative concentration, as shown in equation (28) set forth below.

$$\omega_1 = \frac{\eta \bar{\rho}_i}{\eta \sum_i \bar{\rho}_i} = \frac{\bar{\rho}_i}{\bar{\rho}_{C1} + \bar{\rho}_{C2} + \bar{\rho}_{C3} + \bar{\rho}_{C4} + \bar{\rho}_{C5} + \bar{\rho}_{C6+} + \bar{\rho}_{CO2}} \tag{28}$$

Note that the above analysis is presented in terms of DFA with respect to specific compositional components: namely: C1, C2, C3, C4, C5, C6+ and CO2. Nonetheless, the above analysis and the rest of the present disclosure may also be applicable or readily adaptable to fluid analysis with respect to other compositional components, perhaps including C3-5, C6 and/or C7+, among myriad others within the scope of the present disclosure.

FIG. 1 is a flow-chart diagram of a workflow 100 according to aspects of the present disclosure and embodying the above analysis. Inputs 105 may comprise optical densities, perhaps converted to obtain the OD data corresponding to the appropriate number of channels (i.e., the number of channels of the downhole tool spectrometer). However, pressure, temperature and/or other information may also be considered as inputs.

The method 100 comprises an optional step 110 to de-water the optical spectrum. Water that may exist in the flowline can exhibit interference with hydrocarbon and CO2 peaks and therefore cause inaccuracy in the interpretation of the spectral data. De-watering may be optional, however, such that the de-watering step 110 of the method 100 may be skipped if, for example, the presence of water is not observed. Nonetheless, if the method 100 does indeed include the de-watering step 110, the de-watering may be performed utilizing any known or future-developed algorithm, process or approach.

The method 100 also comprises an optional step 115 to de-color the optical spectrum, such as when the sampled formation fluid has color (e.g., when the sampled formation fluid comprises heavy oil(s)) that would otherwise cause inaccuracy in the interpretation of the spectral data. The method 100 also comprises another optional step 120 to de-scatter the optical spectrum, such as when the sampled formation fluid comprises emulsions, bubbles, particles, precipitates, fines and/or other contaminants that would otherwise cause inaccuracy in the interpretation of the spectral data. Again, while these steps 115 and 120 are optional, if the method 100 does indeed include the de-coloring step 115 and/or the de-scattering step 120, they may be performed utilizing any known or future-developed algorithm, process or approach.

A decisional step 125 then determines which fluid type is predominant in the sample, using, the scoring technique described above if the predominant fluid type is determined to be oil, then the mapping matrix calibrated for oil is utilized in step 130 to estimate the composition of the sample. If is determined during decisional step 125 that the predominant fluid type in the sample is gas, then the mapping matrix calibrated for gas is utilized in step 135 to estimate the composition of the sample. And if it is determined during decisional step 125 that the predominant fluid type in the sample is gas condensate, then the mapping matrix calibrated for gas condensate is utilized, in step 140 to estimate the composition of the sample.

The method 100 may also comprise optional steps for estimating the gas-oil-ratio (GOR) of the sample. For example, if the decisional step 125 indicated that the predominant fluid type in the sample is oil, then the GOR of the sample may be estimated in step 145 using a first algorithm and/or technique for estimating GOR, perhaps utilizing the composition estimate generated during step 130. If the decisional step 125 indicated, that the predominant fluid type in the sample is gas, then the GOR of the sample may be estimated in step 150 using a second algorithm and/or technique for estimating the GOR, perhaps utilizing the composition estimate generated during step 135. If the decisional step 125 indicated that the predominant fluid type in the sample is as condensate, then the GOR of the sample may be estimated in step 155 using a third algorithm and/or technique for estimating the GOR, perhaps utilizing the composition estimate generated during step 140. The first, second and third algorithms and/or techniques utilized to estimate the GOR in steps 145, 150 and 155, respectively, may be substantially similar to or different from each other. Moreover such first, second and third algorithms and/or techniques may be or comprise known and/or future-developed algorithms and/or techniques.

Figure 2:
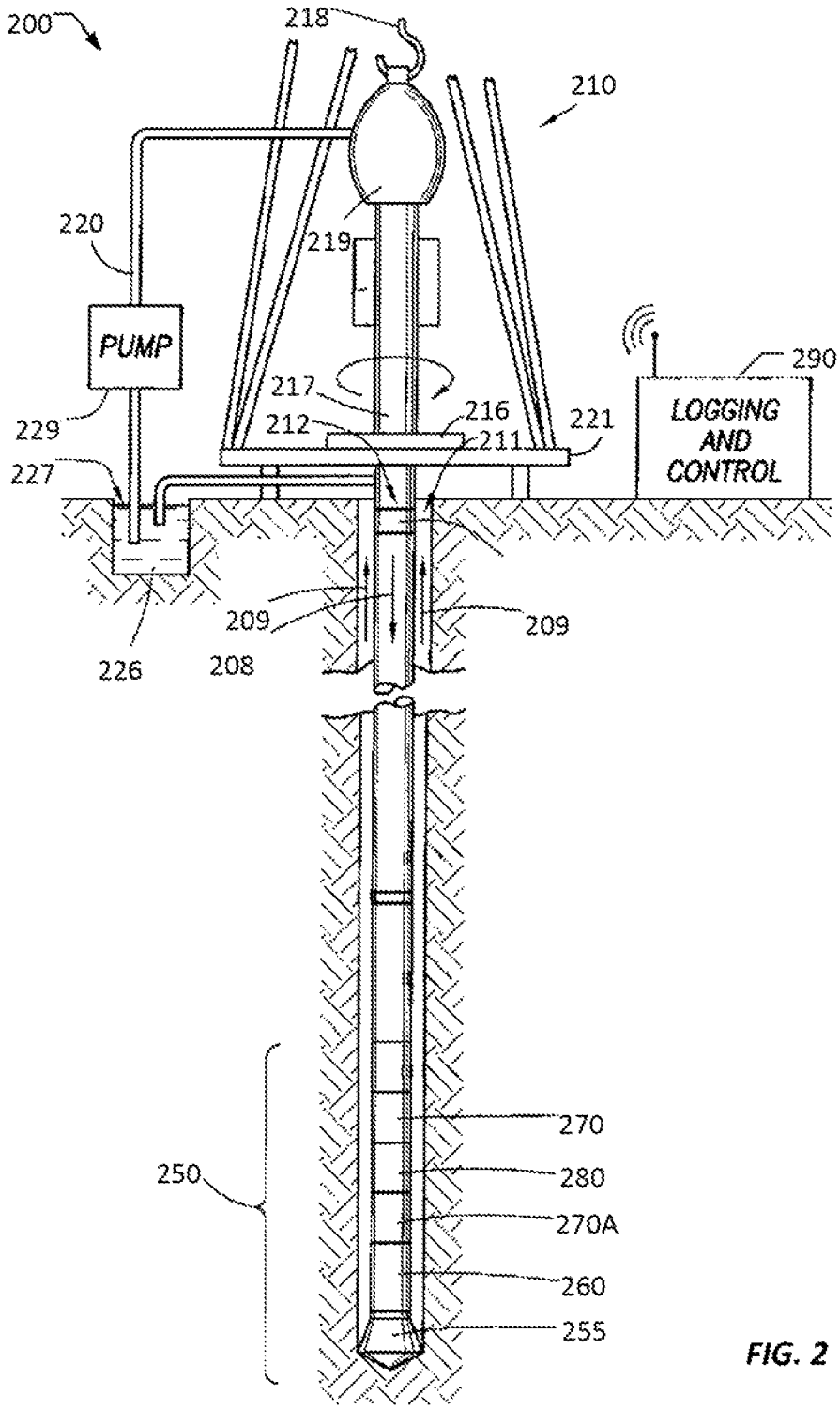
FIG. 2 is a schematic view of apparatus according to one or more aspects of the present disclosure.

FIG. 2 is a schematic view of an example wellsite system 200 in which one or more aspects of DFA disclosed herein may be employed. The wellsite 200 may be onshore or offshore. In the example system shown in FIG. 2, a borehole 211 is formed in subterranean formations by rotary drilling. However, other example systems within the scope of the present disclosure may alternatively or additionally use directional drilling.

As shown in FIG. 2, a drillstring 212 suspended within the borehole 211 comprises a bottom hole assembly 250 that includes a drill bit 255 at its lower end. The surface system includes a platform and derrick assembly 210 positioned over the borehole 211. The assembly 210 may comprise a rotary table 216, a kelly 217, a hook 218 and a rotary swivel 219. The drill string 212 may be suspended from a lifting gear (not shown) via the hook 218, with the lifting gear being coupled to a mast (not shown) rising above the surface. An example lifting gear includes a crown block whose axis is affixed to the top of the mast, a vertically traveling block to which the hook 218 is attached, and a cable passing through the crown block and the vertically traveling block. In such an example, one end of the cable is affixed to an anchor point, whereas the other end is affixed to a winch to raise and lower the hook 218 and the drillstring 212 coupled thereto. The drillstring 212 comprises one or more types of drill pipes threadedly attached one to another, perhaps including wired drilled pipe.

The drillstring 212 may be raised and lowered by turning the lifting, gear with the winch, which may sometimes require temporarily unhooking the drillstring 212 from the lifting gear. In such scenarios, the drillstring 212 may be supported by blocking it with wedges in a conical recess of the rotary table 216, which is mounted on a platform 221 through which the drillstring 212 passes.

The drillstring 212 may be rotated by the rotary table 216, which engages the kelly 217 at the upper end of the drillstring 212. The drillstring 212 is suspended from the hook 218, attached to a traveling block (not shown), through the kelly 217 and the rotary swivel 219, which permits rotation of the drillstring 212 relative to the hook 218. Other example wellsite systems within the scope of the present disclosure may utilize a top drive system to suspend and rotate the drillstring 212, whether in addition to or as an alternative to the illustrated rotary table system.

The surface system may further include drilling fluid or mud 226 stored in a pit 227 formed at the wellsite. A pump 229 delivers the drilling fluid 226 to the interior of the drillstring 212 via a hose 220 coupled to a poll, in the swivel 219, causing the drilling fluid to flow downward through the drillstring 212 as indicated by the directional arrow 208. The drilling fluid exits the drillstring 212 via ports in the drill bit 255, and then circulates upward through the annulus region between the outside of the drillstring 212 and the wall of the borehole 211, as indicated by the directional arrows 209. In this manner, the drilling fluid 226 lubricates the drill bit 255 and carries formation cuttings up to the surface as it is returned to the pit 227 for recirculation.

A bottom hole assembly (BHA) 250 may comprise one or more specially-made drill collars near the drill bit 255. Each such drill collar may comprise one or more logging devices, thereby allowing downhole dulling conditions and/or various characteristic properties of the geological formation (e.g., such as layers of rock or other material) intersected by the borehole 211 to be measured as the borehole 211 is deepened. For example, the bottom hole assembly 250 may comprise a logging-while-drilling (LWD) module 270, a measurement-while-drilling (MWD) module 280, a rotary-steerable system and motor 26, and the drill bit 255. Of course, other BHA components, modules and/or tools are also within the scope of the present disclosure.

The LWD module 270 may be housed in a drill collar and may comprise one or more logging tools, it will also be understood that more than one LWD and/or MWD module can be employed, e.g., as represented at 270A. References herein to a module at the position of 270 may mean a module at the position of 270A as well. The LWD module 270 may comprise capabilities for measuring, processing and storing information, as well as for communicating with the surface equipment.

The MWD module 280 may also be housed in a drill collar and may comprise one or more devices for measuring characteristics of the drillstring 212 anchor drill bit 255. The MWD module 280 may further comprise an apparatus (not shown) for generating electrical power to be utilized by the downhole system. This may include a mud turbine generator powered by the flow of the drilling fluid 226, it being understood that other power and/or battery systems may also or alternatively be employed. In the example shown in FIG. 2, the MWD module 280 comprises one or more of the following types of measuring devices: a weight-on-bit measuring device, a torque measuring, device, a vibration measuring device, a shock measuring device, a stick slip measuring device, a direction measuring device, and an inclination measuring device, among others within the scope of the present disclosure. The wellsite system 200 also comprises a logging and control unit 290 communicably coupled in any appropriate manner to the LWD modules 270/270A and/or the MWD module 280.

The LWD modules 270/270A and/or the MWD module 280 comprise a downhole tool configured to obtain downhole a sample of fluid from the subterranean formation and perform DFA to estimate the composition of the obtained fluid sample. Such DFA is according to one or more aspects described elsewhere herein. The downhole fluid analyzer may then report the composition data to the logging and control unit 290.

Figure 3:
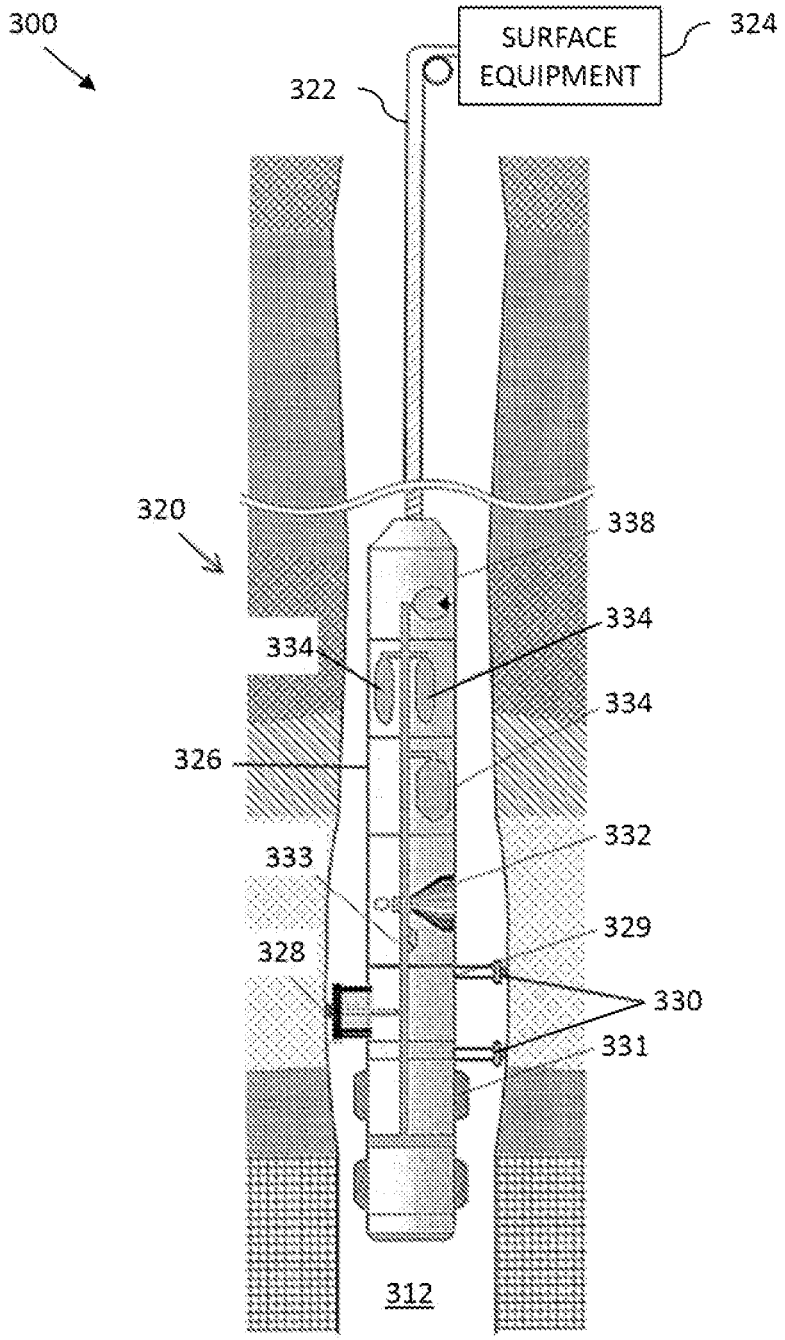
FIG. 3 is a schematic view of apparatus according to one or more aspects of the present disclosure.

FIG. 3 is a schematic view of another exemplary operating environment of the present disclosure wherein a downhole tool 320 is suspended at the end of a wireline 322 at a wellsite having a borehole 312. The downhole tool 320 and wireline 322 are structured and arranged with respect to a service vehicle (not shown) at the wellsite. As with the system 200 shown in FIG. 2, the exemplary system 300 of FIG. 3 may be utilized for downhole sampling and analysis of formation fluids. The system 300 includes the downhole tool 320, which may be used for testing earth formations and analyzing the composition of fluids from a formation, and also includes associated telemetry and control devices and electronics, and surface control and communication equipment 324. The downhole tool 320 is suspended in the borehole 312 from the lower end of the wireline 322, which may be a multi-conductor logging cable spooled on a winch (not shown). The wireline 322 is electrically coupled to the surface equipment 324.

The downhole tool 320 comprises an elongated body 326 encasing, a variety of electronic components and modules, which are schematically represented in FIG. 3, for providing necessary and desirable functionality to the downhole tool 320. A selectively extendible fluid admitting assembly 328 and one or more selectively extendible anchoring members 330 are respectively arranged on opposite sides of the elongated body 326. The fluid admitting assembly 328 is operable to selectively seal off or isolate selected portions of the borehole wall 312 such that pressure or fluid communication with the adjacent formation may be established. The fluid admitting assembly 328 may be or comprise a single probe module 329 and/or a packer module 331.

One or more fluid sampling and analysis modules 332 are provided in the tool body 326. Fluids obtained from the formation and/or borehole flow through a flowline 333, via the fluid analysis module or modules 332, and then may be discharged through a port of a pumpout module 338. Alternatively, formation fluids in the flowline 333 may be directed to one or more fluid collecting chambers 334 for receiving and retaining the fluids obtained from the formation for transportation to the surface.

The fluid admitting assemblies, one or more fluid analysis modules, the flow path and the collecting chambers, and other operational elements of the downhole tool 320 may be controlled by one or more electrical control systems within the downhole tool 320 and/or the surface equipment 324. For example, such control system(s) may include processor capability for characterization of formation fluids in the downhole tool 320 according to one or more aspects of the present disclosure. Methods within the scope of the present disclosure may be embodied in one or more computer programs that run in a processor located, for example, in the downhole tool 320 and/or the surface equipment 324. Such programs are configured to utilize data received from, for example, the fluid sampling and analysis module 332, via the wireline cable 322, and to transmit control signals to operative elements of the downhole tool 320. The programs may be stored on a suitable computer usable storage medium associated with the one or more processors of the downhole tool 320 and/or surface equipment 324, or may be stored on an external computer usable storage medium that is electronically coupled to such processor(s) for use as needed. The storage medium may be any one or more of known or future-developed storage media, such as a magnetic disk, an optically readable disk, flash memory or a readable device of any other kind, including a remote storage device coupled over a switched telecommunication link, among others.

FIGS. 2 and 3 illustrate mere examples of environments in which one or more aspects of the present disclosure may be implemented. For example, in addition to the drillstring environment of FIG. 2 and the wireline environment of FIG. 3, one or more aspects of the present disclosure may be applicable or readily adaptable for implementation in other environments utilizing other means of conveyance within the wellbore, including coiled tubing. TLC, slickline, and others.

Figure 4:
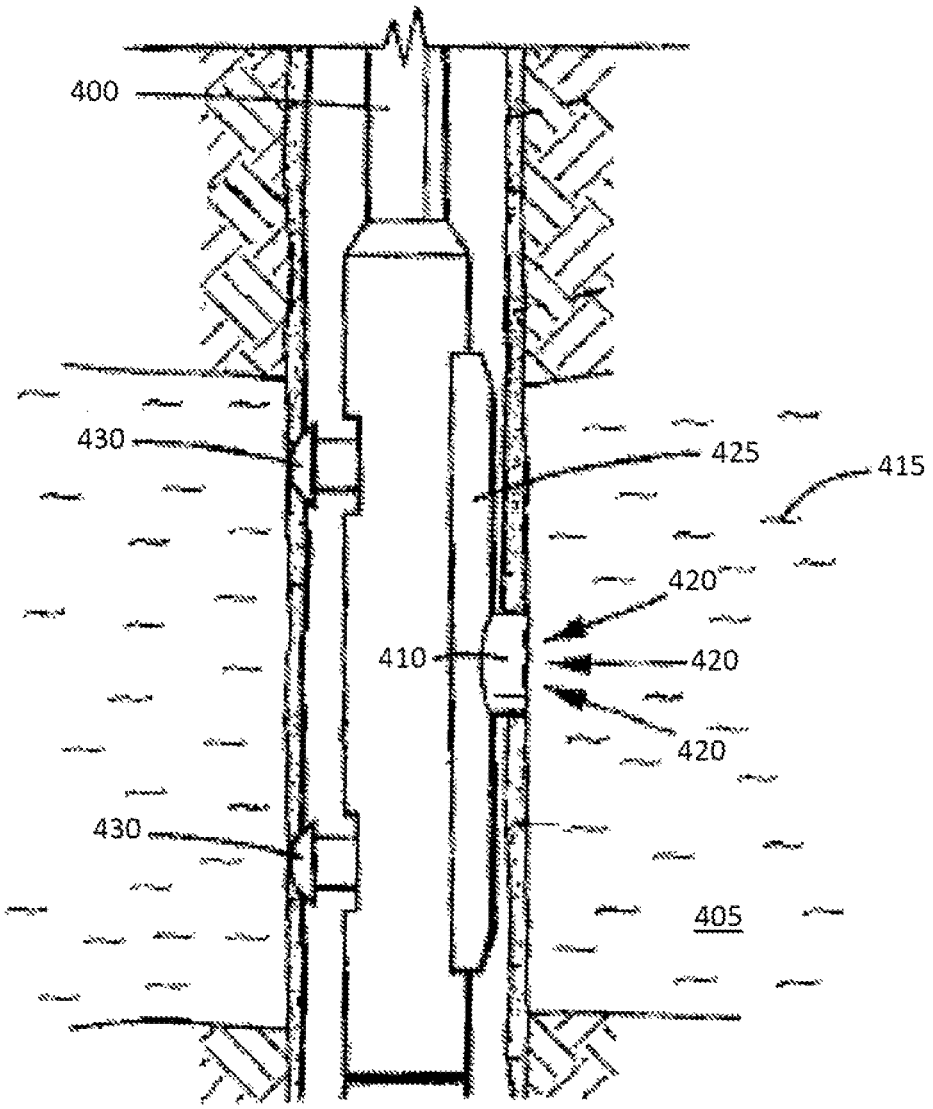
FIG. 4 is a schematic view of apparatus according to one or more aspects of the present disclosure.

An example downhole tool or module 400 that may be utilized in the example systems 200 and 300 of FIGS. 2 and 3, respectively, such as to obtain a sample of fluid from a subterranean formation 305 and perform DFA to estimate the composition of the obtained fluid sample, is schematically shown in FIG. 4. The tool 400 is provided with a probe 410 for establishing fluid communication with the formation 405 and drawing formation fluid 415 into the tool, as indicated by arrows 420. The probe 410 may be positioned in a stabilizer blade 425 of the tool 400 and extended therefrom to engage the borehole wall. The stabilizer blade 425 may be or comprise one or more blades that are in contact with the borehole wall. Alternatively, or additionally, the tool 400 may comprise backup pistons 430 configured to press the tool 400 and, thus, the probe 410 into contact with the borehole wall. Fluid drawn into the tool 400 via the probe 410 may be measured to determine, for example, pretest and/or pressure parameters. Additionally, the tool 400 may be provided with chambers and/or other devices for collecting fluid samples for retrieval at the surface.

Figure 5:
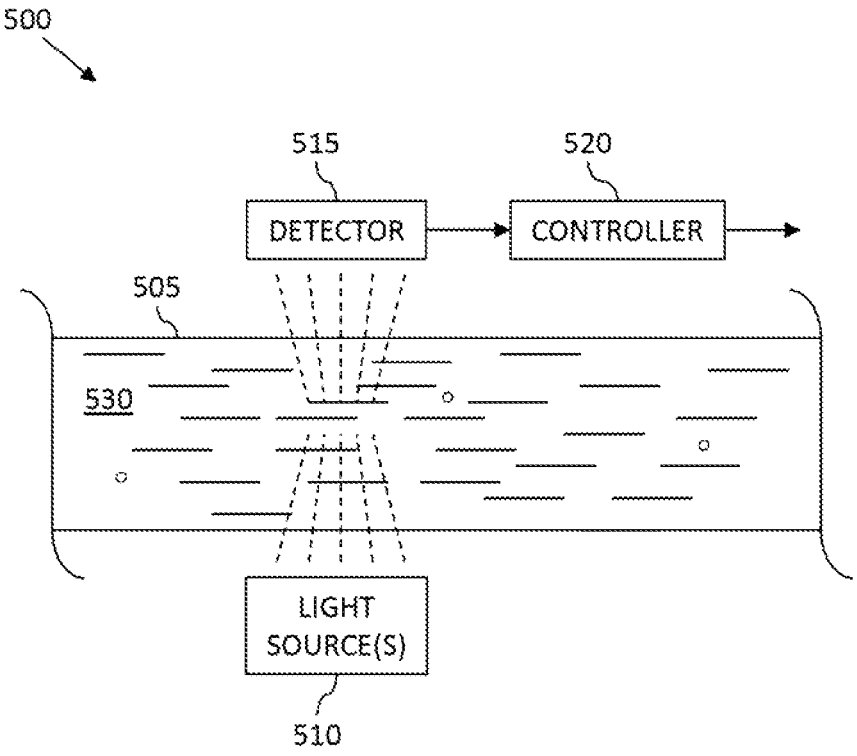
FIG. 5 is a schematic view of apparatus according to one or more aspects of the present disclosure.

An example downhole fluid analyzer 500 that may be used to implement DFA in the example downhole tool 400 shown in FIG. 4 is schematically shown in FIG. 5. The downhole fluid analyzer 500 may be part of or otherwise work in conjunction with a downhole tool configured to obtain a sample of fluid 530 from the formation, such as the downhole tools/modules shown in FIGS. 2-4. For example, a flowline 505 of the downhole tool may extend past an optical spectrometer having one or more light sources 510 and a detector 515. The detector 515 senses light that has transmitted through the formation fluid 530 in the flowline 505, resulting in optical spectra that may be utilized according to one or more aspects of the present disclosure. For example, a controller 520 associated with the downhole fluid analyzer 500 and/or the downhole tool may utilize measured optical spectra to estimate the composition of the formation fluid 530 in the flowline according to one or more aspects of DFA introduced herein. The resulting information may then be reported via any form of telemetry to surface equipment, such as the logging and control unit 290 shown in FIG. 2 or the surface equipment 324 shown in FIG. 3. Moreover, the downhole fluid analyzer 500 may perform the bulk of its processing downhole and report just a relatively small amount of measurement data up to the surface. Thus, the downhole fluid analyzer 500 may provide high-speed (e.g., real time DFA measurements using a relatively low bandwidth telemetry communication link. As such, the telemetry communication link may be implemented by most types of communication links, unlike conventional DFA techniques that require high-speed communication links to transmit high-bandwidth signals to the surface.

Figure 6:
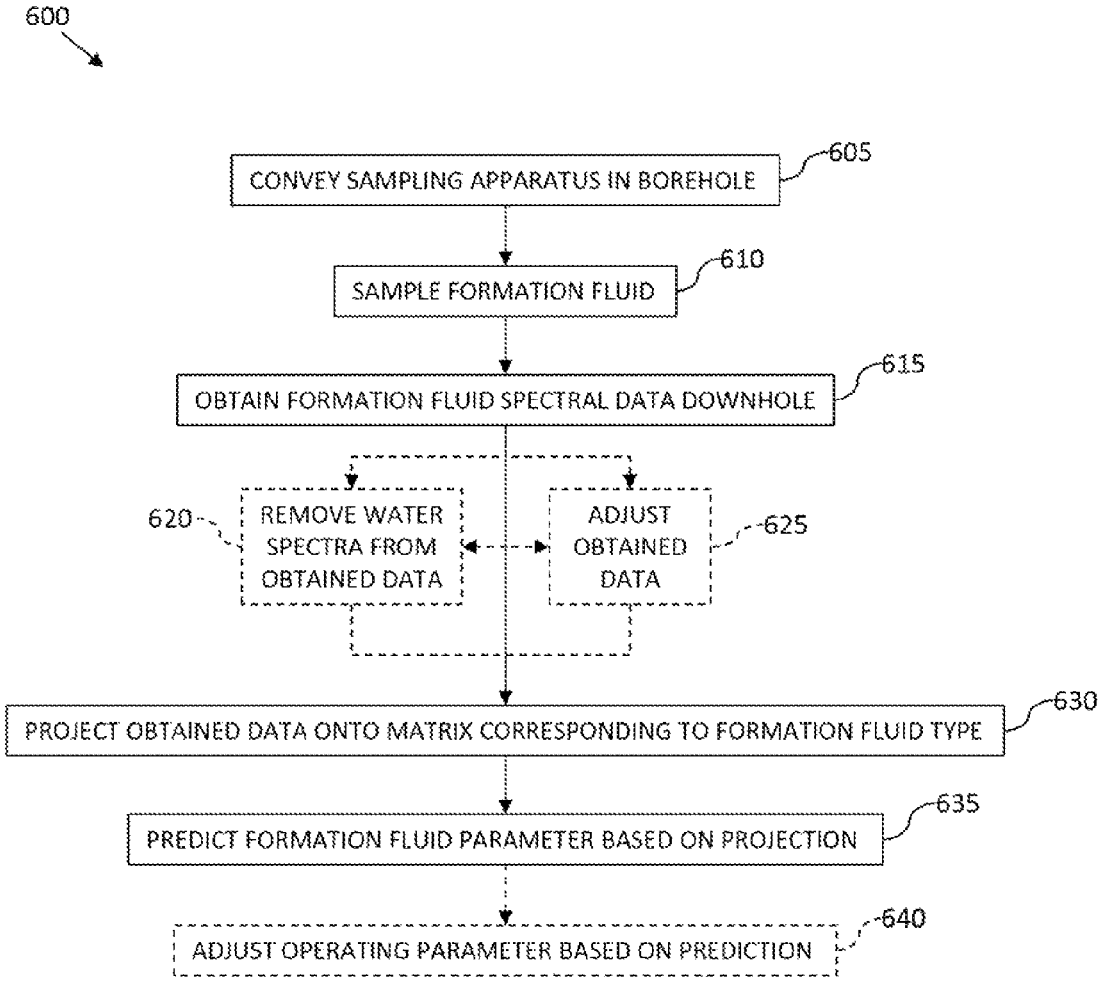
FIG. 6 is a flow-chart diagram of at least a portion of a method according to one or more aspects of the present disclosure.

FIG. 6 is a flow-chart diagram of at least a portion of a method 600 according to one or more aspects of the present disclosure. The method 600 may be at least partially performed by apparatus similar or identical to those shown in the previous figures, described above, or otherwise within the scope of the present disclosure. For example, the method 600 includes a step 605 during which a downhole sampling tool is conveyed along a borehole extending into a subterranean formation, wherein the downhole sampling tool may have one or more aspects in common with the apparatus 270/270A/280 shown in FIG. 2 and/or the apparatus 320 shown in FIG. 3, and may further be part of a BHA having one or more aspects in common with the BHA 250 shown in FIG. 2. The downhole sampling tool may be conveyed via wireline, one or more strings of tubulars (including drillstring, and/or wired drill pipe), and/or other means. Once reaching the desired subterranean formation or station within the borehole, the downhole sampling tool obtains formation fluid from the formation during a step 610.

The sampled formation fluid is then subjected to in-situ downhole analysis via a spectrometer of the downhole sampling tool during a step 615, thereby obtaining spectral data representative of the sampled formation fluid. Such spectral data associated with the formation fluid flowing through the downhole formation fluid sampling apparatus may be obtained, at least in part, via a multi-channel optical sensor of the downhole formation fluid sampling apparatus, such as the optical detector 515 and/or a larger portion or all of the downhole fluid analyzer 500, each shown in FIG. 5 and described above. The sensor, detector, spectrometer and/or analyzer utilized to obtain the spectral data during step 615 may be or comprise a 20-channel spectrometer, although spectrometers utilizing more or less than 20 channels are also within the scope of the present disclosure. Obtaining the spectral data during step 615 may also be performed while, the downhole sampling apparatus pumps formation fluid from the formation downhole and through the flowline of the downhole sampling tool, or the spectral data may be obtained utilizing, a static sample of formation fluid captured in a chamber of the downhole formation fluid sampling apparatus.

The method 600 also comprises an optional step 620 during which water spectra are removed from the measured optical spectra, as described above with respect to step 110 of FIG. 1, among other de-watering processes also within the scope of method 600. An additional optional step 625 may comprise further types of adjustment of the measured optical spectra. For example, step 625 may comprise de-coloring the measured optical spectra, de-scattering the measured optical spectra, and/or other adjustments, as described above with respect to steps 115 and 120 of FIG. 1. For example, one such adjustment that may be performed during the optional step 625 may comprise adjusting the obtained spectral data so that optical density at a predetermined wavelength (e.g., 1600 nm) is zero, which may reduce the effects of scattering and the refractive index of the formation fluid.

In a subsequent step 630, the measured optical spectra are projected onto a matrix corresponding to the predominant fluid type of the sampled formation fluid. The predominant fluid type of the sample formation fluid may be determined via one or more methods within the scope of the present disclosure, and/or any other method by which the predominant fluid type can be known or determined prior to performing this step 630. The projection performed during step 630 is then utilized during a subsequent step 635 to predict or estimate a parameter of the formation fluid.

The method 600 may also comprise a step 640 during which an operational parameter of the downhole sampling tool may be adjusted based on the formation fluid parameter predicted or estimated during, step 635. For example, step 640 may comprise initiating storage of a sample of the formation fluid flowing through the downhole formation fluid sampling apparatus based on the predicted or estimated parameter. Alternatively, or additionally, the step 640 may comprise adjusting a rate of pumping of formation fluid into the downhole formation fluid sampling apparatus based on the predicted or estimated parameter.

As shown in FIG. 6, the method 600 may proceed from step 615 directly to step 630, or the method 600 may comprise performing one or both of steps 620 and 625 between steps 615 and step 630. Steps 620 and 625 may also be performed in any order, as indicated by the double-headed arrow in FIG. 6.

Figure 7:
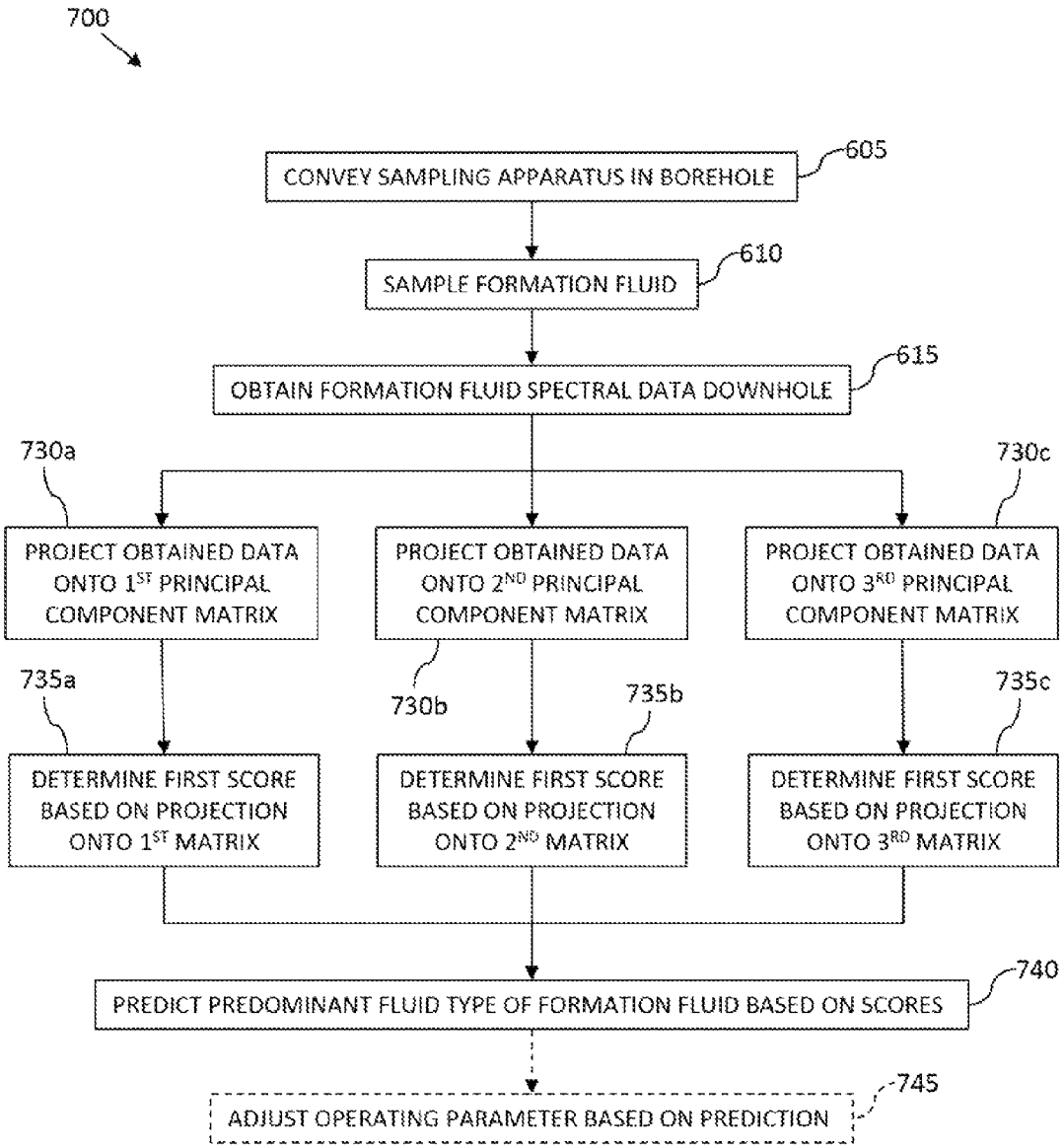
FIG. 7 is a flow-chart diagram of at least a portion of a method according to one or more aspects of the present disclosure.

FIG. 7 is a flow-chart diagram of at least a portion of a method 700 according to one or more aspects of the present disclosure. The method 700 may be at least partially performed by apparatus similar or identical to those shown in the previous figures, described above, or otherwise within the scope of the present disclosure. Moreover, aspects of the method 700 are similar or identical to those of the method 600 shown in FIG. 6 and described above. For example, the repeat of reference numerals and/or letters in FIGS. 6 and 7 indicates aspects of FIGS. 6 and 7 that are similar or identical. Accordingly, the method 700 comprises steps 605, 610 and 615, and perhaps optional steps 620 and 625, which are described in detail above with respect to the method 600 shown in FIG. 6. However although only for the sake of clarity, the optional steps 620 and 625 are not shown in FIG. 7.

The method 700 also comprises steps 730*a-c*, during which the obtained and potentially adjusted spectral data is projected onto each of first, second and third matrices of principal components. The first, second and third principal component matrices each correspond to a predominant fluid type, namely oil, gas and gas condensate, respectively. The first principal component matrix may comprise one or more first principal components corresponding to ones of a plurality of known compositions having a predominant fluid type of oil. The second principal component matrix may comprise one or more second principal components corresponding to ones of the plurality of known compositions having a predominant fluid type of gas. The third principal component matrix may comprise one or more third principal components corresponding to ones of the plurality of known compositions having a predominant fluid type of gas condensate.

First, second and third scores are then determined during subsequent steps 735*a-c*, based on the projections performed during steps 730*a-c*, respectively. For example, this may comprise determining, a first score corresponding to projection of the obtained spectral data onto the one or more first principal components, determining a second score corresponding to projection of the obtained spectral data onto the one or more second principal components, determining a third score corresponding to projection of the obtained spectral data onto the one or more third principal components.

The first, second and third scores are then utilized during step 740 to predict a predominant fluid type of the formation fluid flowing through the downhole formation fluid sampling apparatus. For example, determining the predominant fluid type may be determined based on a comparison of the first, second and third scores. The highest score, for example, may indicate which of the three fluid types is predominant in the sampled formation fluid.

The projection, scoring and comparison process of steps 730-740 to predict the predominant fluid type may be as described above with respect to equations (23)-(26) and their accompanying text. However, other processes are also within the scope of the method 700.

The principal component matrices utilized in the method 700 may each result from SVD or other principal component analysis (PCA) of preexisting spectral data associated with a plurality of known compositions. Such preexisting spectral data may be the result of preexisting spectral analyses of one or more of the known compositions as previously measured by a spectrometry portion of the downhole formation fluid sampling apparatus. The preexisting data may also or alternatively be the result of preexisting spectral analyses of one or more of the known compositions as previously measured by one or more spectrometry devices that are not associated with the downhole formation fluid sampling apparatus. Such "non-associated" devices may be or comprise one or more of a spectrometry portion of apparatus positioned at the surface of the wellbore, a spectrometry portion of a second downhole formation fluid sampling apparatus positioned in the wellbore or a second wellbore extending into the subterranean formation or another subterranean formation, and a spectrometry portion of lab-based apparatus.

The preexisting spectral data may also be normalized by a weight fraction by compositional component of each formation fluid sample of known composition, as described above with respect to equation (5). The preexisting spectral data may also represent spectra data converted from a first number of wavelengths to a second number of wavelengths, wherein the second number is less than the first number, and wherein the second number is not greater than the number of channels of the multi-channel optical sensor utilized during step 615. For example, the laboratory-obtained spectra may represent data obtained from a 32-channel spectrometer that has been convened to represent the number of channels (e.g., 20 channels) of the spectrometry device of the downhole formation fluid sampling tool. As also described above, the laboratory-obtained spectra, whether convened into a different number of channels or not, may be adjusted to account for spectrometry hardware dependency and/or statistical noise, for example.

Although not shown in FIG. 7, the method 700 may also comprise performing the PCA of the preexisting spectral data associated with the plurality of known compositions to determine the plurality of principal components. Performing the PCA of the preexisting spectral data to determine the plurality of principal components may comprise vertically aligning the preexisting spectral data to a predetermined wavelength, normalizing the vertically aligned preexisting spectral data by summation over available spectral data points, and determining the plurality of principal components via PCA of the normalized, vertically aligned preexisting spectral data. Such process is introduced above in the description accompanying equation (23).

Additionally, or alternatively, performing the PCA of the preexisting spectral data to determine the plurality of principal components may comprise determining one or more first principal components via PCA of a first portion of the preexisting spectral data that corresponds to ones of the plurality of known compositions that have a predominant fluid type of oil, determining one or more second principal, components via PCA of a second portion of the preexisting spectral data that corresponds to ones of the plurality of known compositions that have a predominant fluid type of gas, and determining one or more third principal components via PCA of a third portion of the preexisting spectral data that corresponds to ones of the plurality of known compositions that have a predominant fluid type of gas condensate.

The method 700 may also comprise a step 745 during which an operational parameter of the downhole sampling tool may be adjusted based on the predominant fluid type predicted during step 740. For example, step 745 may comprise initiating storage of a sample of the formation fluid flowing through the downhole formation fluid sampling apparatus based on the predicted predominant fluid type. Alternatively, or additionally, the step 745 may comprise adjusting a rate of pumping of formation fluid into the downhole formation fluid sampling apparatus based on the predicted predominant fluid type.

Figure 8:
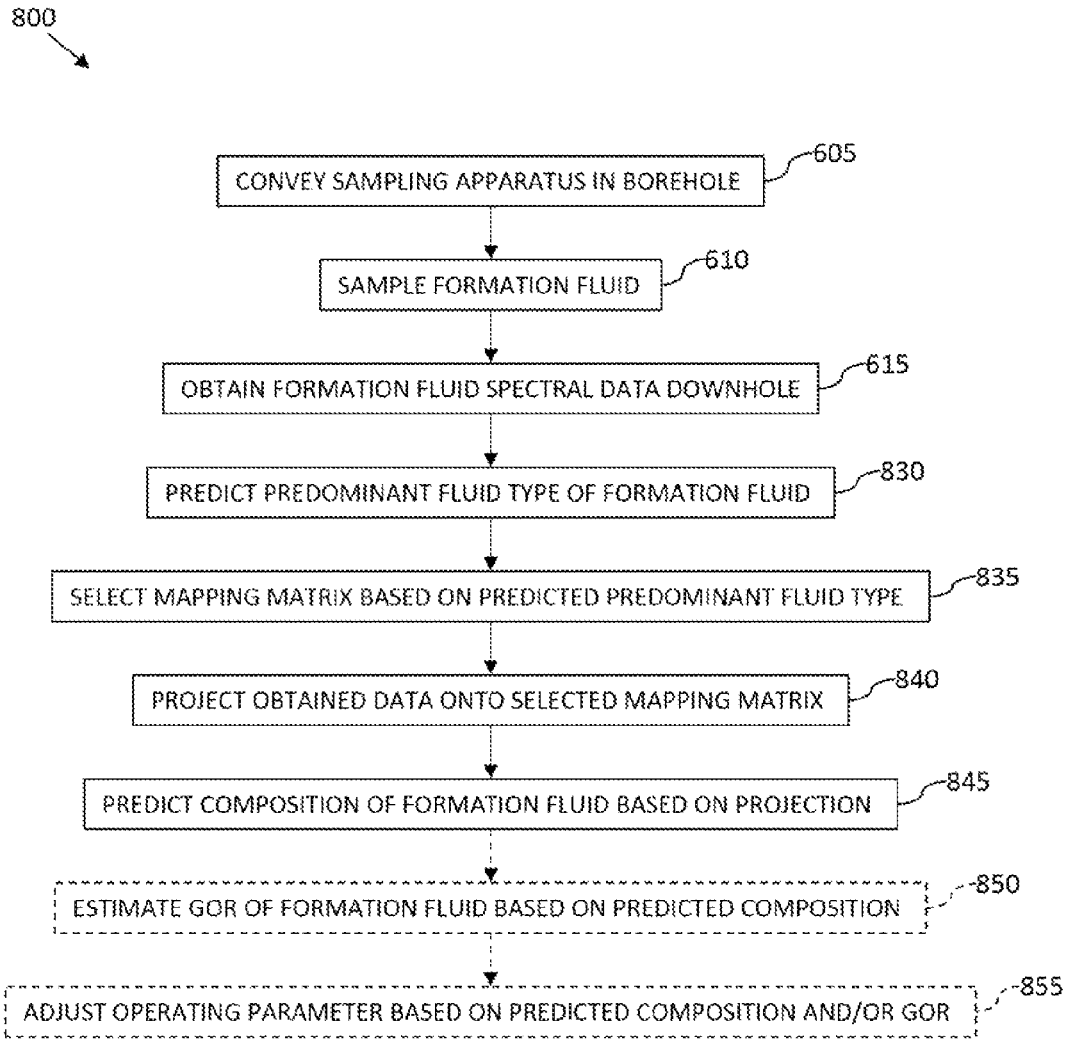
FIG. 8 is a flow-chart diagram of at least a portion of a method according to one or more aspects of the present disclosure.

FIG. 8 is a flow-chart diagram of at least a portion of a method 800 according to one or more aspects of the present disclosure. The method 800 may be at least partially performed by apparatus similar or identical to those shown in the previous figures, described above, or otherwise within the scope of the present disclosure. Moreover, aspects of the method 800 are similar or identical to those of method 600 shown in FIG. 6 and described above. For example, the repeat of reference numerals and/or letters in FIGS. 6 and 8 indicates aspects of FIGS. 6 and 8 that are similar or identical. Accordingly, the method 800 comprises steps 605, 610 and 615, and perhaps optional steps 620 and 625, which are described in detail above with respect to the method 600 shown in FIG. 6. However, although only for the sake of clarity, the optional steps 620 and 625 are not shown in FIG. 8.

The method 800 also comprises a step 830 during which the predominant fluid type of the formation fluid is predicted. Such prediction may be as described above, including as shown in FIG. 7, although other methods of predicting the predominant fluid type of the formation fluid may also or alternatively be utilized during step 830.

In a subsequent step 835, a mapping matrix is selected based on the predominant fluid type predicted in step 830. As in the description above, the fluid types may comprise or consist of oil, gas and gas condensate, and the mapping matrices selected from may comprise a first mapping matrix corresponding to compositions having a predominant fluid type of oil, a second mapping matrix corresponding, to compositions having a predominant fluid type of gas, and a third mapping matrix corresponding to compositions having a predominant fluid type of gas condensate. Each mapping matrix may represent a linear relationship between preexisting spectral data and relative concentrations of predetermined compositional components of a plurality of known compositions, such as is described above with respect to equations (15)-(18) and their accompanying text. The first mapping matrix may also compensate for color, as it corresponds to oil compositions. However, the second and third mapping matrices may not compensate for color, as they correspond to compositions of gas and gas condensate, respectively.

As described above, the mapping matrices may each result from partial least squares (PLS) regression analysis of preexisting spectral data associated with a plurality of known compositions, as described above. Although not shown in FIG. 8, the method 800 may also comprise performing the PLS regression analysis of the preexisting spectral data to determine the plurality of mapping matrices from which one is selected during, step 835. For example, performing the PLS regression analysis of the preexisting spectral data to determine the mapping matrices may comprise determining a first mapping, matrix via PLS regression analysis of a first portion of the preexisting spectral data that corresponds to ones of the plurality of known compositions that have a predominant fluid type of oil, determining a second mapping matrix via PLS regression analysis of a second portion of the preexisting spectral data that corresponds to ones of the plurality of known compositions that have a predominant fluid type of gas, and determining a third mapping matrix via PLS regression analysis of a third portion of the preexisting spectral data that corresponds to ones of the plurality of known compositions that have a predominant fluid type of gas condensate. However, the PLS regression analysis performed to determine the mapping matrices may be separate from the method 800.

After the appropriate mapping matrix is selected in step 835, the formation fluid spectral data obtained downhole during step 615 is projected Onto the selected mapping matrix during a step 840. The composition of the formation fluid flowing through the downhole formation fluid sampling apparatus is then predicted in step 845 based on the projection of the obtained spectral data onto the selected mapping matrix. Predicting the composition may comprise, for example, estimating a weight fraction of each of a plurality of components of the formation fluid flowing through the downhole formation fluid sampling apparatus. The plurality of components of the formation fluid flowing, through the downhole formation fluid sampling apparatus may comprise or consist of C1, C2, C3, C4, C5, C6+ and CO2, although other components are also within the scope of method 800.

The method 800 may also comprise a step 850 during which a gas-to-oil ratio (GOR) of the formation fluid flowing through the downhole formation fluid sampling apparatus is estimated based on the composition predicted in step 845. Any known or future-developed methods may be utilized during step 850 to estimate the GOR.

The method 800 may also comprise a step 855 during which an operational parameter of the downhole sampling tool may be adjusted based on the composition predicted during step 845 and/or the GOR estimated during step 850. For example, step 855 may comprise initiating storage of a sample of the formation fluid flowing through the downhole formation fluid sampling apparatus based on the predicted composition and/or GOR. Alternatively, or additionally, the step 855 may comprise adjusting a rate of pumping of formation fluid into the downhole formation fluid sampling apparatus based on the predicted composition and/or GOR.

Figure 9:
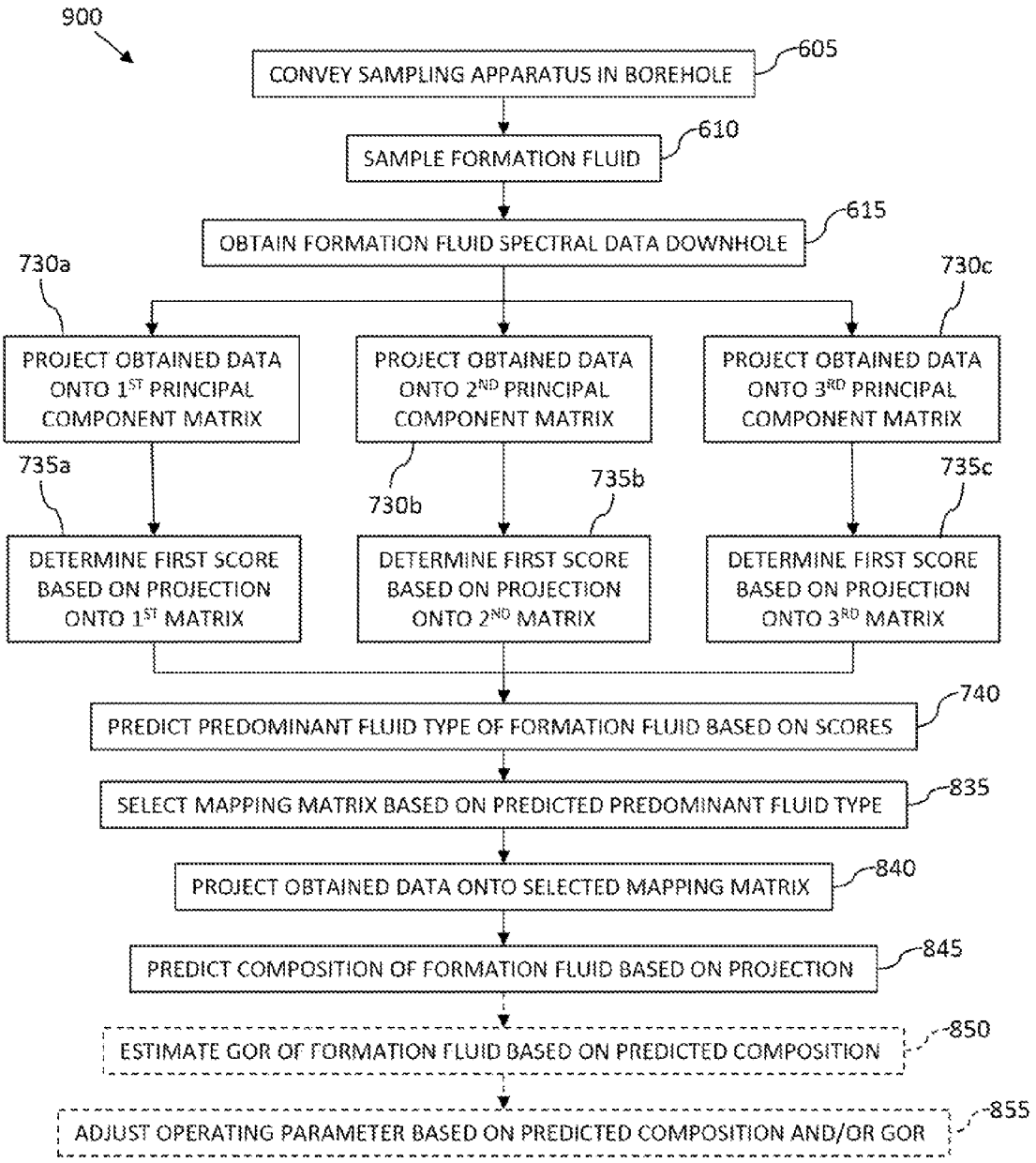
FIG. 9 is a flow-chart diagram of at least a portion of a method according to one or more aspects of the present disclosure.

FIG. 9 is a flow-chart diagram of at least a portion of a method 900 according to one or more aspects of the present disclosure. The method 900 may be at least partially performed by apparatus similar or identical to those shown in the previous figures, described above, or otherwise within the scope of the present disclosure.

Moreover, aspects of the method 900 are similar or identical to those of methods 600, 700 and 800 shown in FIGS. 6, 7 and 8, respectively, and as otherwise described herein. For example, the repeat of reference numerals and/or letters in FIGS. 6-9 indicates aspects of FIGS. 6-9 that are similar or identical. Accordingly, the method 900 comprises steps 605, 610 and 615, and perhaps optional steps 620 and 625, which are described in detail above with respect to the method 600 shown in FIG. 6. However, although only for the sake of clarity, the optional steps 620 and 625 are not shown in FIG. 9.

In step 605, the downhole formation fluid sampling tool is conveyed in the borehole (via wireline, drillstring, tubulars, and/or other means) to the subterranean formation of interest. The sampling apparatus then obtains a sample of formation fluid during, step 610. The downhole tool then obtains spectral data of the formation fluid sample in step 615, whether such spectrometry is performed on a continuous flow of formation fluid within the downhole tool or, instead, is performed on a static sample of formation fluid captured in the downhole tool.

Various processing may be performed downhole on the obtained spectral data as described above. The obtained spectral data is then projected onto matrices of first, second and third principal components in steps 730*a-c*, and first, second and third scores based thereon are determined during steps 735*a-c*. These scores are then utilized during step 740 to predict a predominant fluid type of the formation fluid obtained during step 610.

The predicted predominant fluid type of the formation fluid is then utilized in step 835 to select the appropriate mapping matrix, such as selecting, a first mapping matrix if the predominant fluid type is oil, selecting a second mapping matrix if the predominant fluid type is gas, and selecting a third mapping matrix if the predominant fluid type is gas condensate. The spectral data obtained in step 615 is then projected onto the selected mapping matrix during step 840. This projection is utilized during step 845 to predict the composition of the formation fluid obtained during step 610.

The method 900 may also comprise a step 850 during which a gas-to-oil ratio (GOR) of the formation fluid flowing through the downhole formation fluid sampling apparatus is estimated based on the composition predicted in step 845. Any known or future-developed methods may be utilized during step 850 to estimate the GOR.

The method 900 may also comprise a step 855 during which an operational parameter of the downhole sampling tool may be adjusted based on the composition predicted during step 845 and/or the GOR estimated during step 850. For example, step 855 may comprise initiating storage of a sample of the formation fluid flowing through the downhole formation fluid sampling apparatus based on the predicted composition and/or GOR. Alternatively, or additionally, the step 855 may comprise adjusting a rate of pumping of formation fluid into the downhole formation fluid sampling apparatus based on the predicted composition and/or GOR.

Additional aspects of the steps of the method 900 shown in FIG. 9 are as described above with regard to similarly numbered steps of the methods 600, 700 and 800 shown in FIGS. 6, 7 and 8, respectively. Among other purposes, the method 900 shown in FIG. 9 illustrates that various steps and/or aspects of the methods described herein may be deleted, added, repeated, substituted, re-ordered and/or otherwise rearranged within the scope of the present disclosure.

Figure 10:
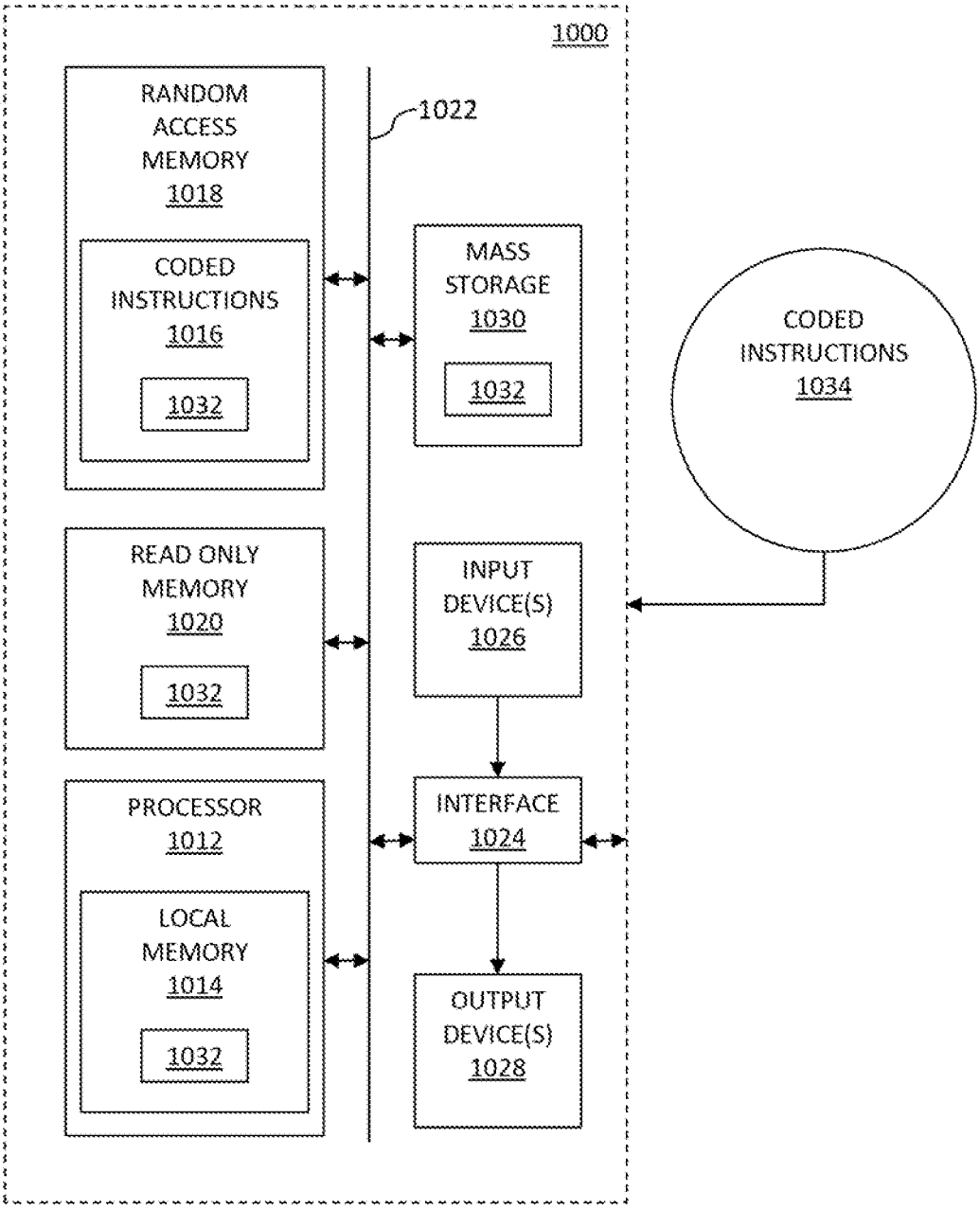
FIG. 10 is a schematic view of apparatus according to one or more aspects of the present disclosure.

FIG. 10 is a block diagram of an example processing system 1000 that may execute example machine readable instructions used to implement one or more of the processes of FIGS. 1, 6, 7, 8 and/or 9, and/or to implement the example downhole fluid analyzers and/or other apparatus of FIGS. 2, 3, 4 and/or 5. Thus, the example processing system 1000 may be capable of implementing the apparatus and methods disclosed herein. The processing system 1000 may be or comprise, for example, one or more processors, one or more controllers, one or more special-purpose computing devices, one or more servers, one or more personal computers, one or more personal digital assistant (PDA) devices, one or more smartphones, one or more internet appliances, and/or any other type(s) of computing device(s). Moreover, while it is possible that the entirety of the system 1000 shown in FIG. 10 is implemented within the downhole tool, it is also contemplated that one or more components or functions of the system 1000 may be implemented in surface equipment, such as the surface equipment 290 shown in FIG. 2, and/or the surface equipment 324 shown in FIG. 3. One or more aspects, components or functions of the system 1000 may also or alternatively be implemented as the controller 520 shown in FIG. 5.

The system 1000 comprises a processor 1012 such as, for example, a general-purpose programmable processor. The processor 1012 includes a local memory 1014, and executes coded instructions 1032 present in the local memory 1014 and/or in another memory device. The processor 1012 may execute, among other things, machine readable instructions to implement the processes represented in FIGS. 1, 6, 7, 8 and/or 9. The processor 1012 may be, comprise or be implemented by any type of processing unit, such as one or more INTEL microprocessors, one or more microcontrollers from the ARM and/or PICO families of microcontrollers, one or more embedded soft/hard processors in one or more FPGAs, etc. Of course, other processors from other families are also appropriate.

The processor 1012 is in communication with a main memory including a volatile (e.g., random access) memory 1018 and a non-volatile (e.g., read only) memory 1020 via a bus 1022. The volatile memory 1018 may be comprise or be implemented by static random access memory (SRAM), synchronous dynamic random access memory (SDRAM), dynamic random access memory (DRAM), RAMBUS dynamic random access memory (RDRAM) and/or any other type of random access memory device. The non-volatile memory 1020 may be, comprise or be implemented by flash memory and/or any other desired type of memory device. One or more memory controllers (not shown) may control access to the main memory 1018 and/or 1020.

The processing system 1000 also includes an interface circuit 1024. The interface circuit 1024 may be, comprise or be implemented by any type of interface standard, such as an Ethernet interface, a universal serial bus (USB) and/or a third generation input/output (3GIO) interface, among others.

One or more input devices 1026 are connected to the interface circuit 1024. The input device(s) 1026 permit a user to enter data and commands into the processor 1012. The input device(s) may be, comprise or be implemented by, for example, a keyboard, a mouse, a touchscreen, a track-pad, a trackball, an isopoint and/or a voice recognition system, anions others.

One or more output devices 1028 are also connected to the interface circuit 1024. The output devices 1028 may be, comprise or be implemented by, for example, display devices (e.g., a liquid crystal display or cathode ray tube display (CRT), among others), printers and/or speakers, among others. Thus, the interface circuit 1024 may also comprise a graphics driver card.

The interface circuit 1024 also includes a communication device such as a modem or network interface card to facilitate exchange of data with external computers via a network (e.g., Ethernet connection, digital subscriber line (DSL), telephone line, coaxial cable, cellular telephone system, satellite, etc.).

The processing system 1000 also includes one or more mass storage devices 1030 for storing machine-readable instructions and data. Examples of such mass storage devices 1030 include floppy disk drives, hard drive disks, compact disk drives and digital versatile disk (DVD) drives, among others.

The coded instructions 1032 may be stored in the mass storage device 1030, the volatile memory 1018, the non-volatile memory 1020, the local memory 1014 and/or on a removable storage medium, such as a CD or DVD 1034.

As an alternative to implementing the methods and/or apparatus described herein in a system such as the processing system of FIG. 10, the methods and or apparatus described herein may be embedded in a structure such as a processor and/or an ASIC (application specific integrated circuit).

In view of all of the above and the figures, those having ordinary skill in the art should readily recognize that the present disclosure introduces a method comprising: obtaining in-situ optical spectral data associated with a formation fluid flowing through a downhole formation fluid sampling apparatus; and predicting a parameter of the formation fluid flowing through the downhole formation fluid sampling apparatus based on projection of the obtained spectral data onto a matrix that corresponds to a predominant fluid type of the formation fluid. The spectral data associated with the formation fluid flowing through the downhole formation fluid sampling apparatus may be obtained at least in part via a multi-channel optical sensor of the downhole formation fluid sampling; apparatus. The multi-channel optical sensor of the downhole formation fluid sampling apparatus may comprise at least one spectrometer. The at least one spectrometer may be a 20-channel spectrometer. Obtaining the optical spectral data associated with the formation fluid flowing through the downhole formation fluid sampling apparatus may be performed by the downhole formation fluid sampling apparatus while the downhole formation fluid sampling apparatus pumps formation fluid from the formation downhole.

The method may further comprise adjusting an operating parameter of the downhole formation fluid sampling apparatus based on the predicted parameter. The method may further comprise initiating storage of a sample of the formation fluid flowing, through the downhole formation fluid sampling apparatus based on the predicted parameter. The method may further comprise adjusting a rate of pumping of formation fluid into the downhole formation fluid sampling apparatus based on the predicted parameter. The method may further comprise removing water spectra from the obtained spectral data before projecting the obtained spectral data onto the matrix that corresponds to the predominant fluid type.

The method may further comprise adjusting the obtained spectral data so that optical density at a predetermined wavelength is zero to reduce effects of scattering, and refractive index of the formation fluid. The predetermined wavelength may be 1600 nm.

The method may further comprise conveying the downhole formation fluid sampling apparatus within a wellbore extending into the formation. The conveying may be via at least one of wireline and a string of tubulars.

Predicting the parameter of the formation fluid flowing through the downhole formation fluid sampling apparatus based on the projection of the obtained spectral data onto the matrix that corresponds to the predominant fluid type may comprise predicting the predominant fluid type of the formation fluid flowing through the downhole formation fluid sampling apparatus based on projection of the obtained spectral data onto a plurality of principal components that each correspond to a particular fluid type. The method may further comprise adjusting the obtained spectral data before projecting the obtained spectral data onto the plurality of principal components, wherein adjusting may comprise at least one of: removing water spectra from the obtained spectral data; reducing effects of formation fluid scattering, and refractive index differences by forcing optical density at a predetermined wavelength to zero; and removing color effects from the obtained spectral data. The predetermined wavelength may be 1600 nm. The plurality of principal components may comprise: one or more first principal components corresponding to ones of a plurality of known compositions having a predominant fluid type of oil; one or more second principal components corresponding to ones of the plurality of known compositions having a predominant fluid type of gas; and one or more third principal components corresponding to ones of the plurality of known compositions having a predominant fluid type of gas condensate. Predicting the predominant fluid type of the formation fluid flowing through the downhole formation fluid sampling apparatus may comprise: determining a first score corresponding to projection of the obtained spectral data onto the one or more first principal components; determining a second score corresponding to projection of the obtained spectral data onto the one or more second principal components; determining a third score corresponding to projection of the obtained spectral data onto the one or more third principal components; and determining the predominant, fluid type based on a comparison of the first, second and third scores.

The plurality of principal components may each result from principal component analysis (PCA) of preexisting spectral data associated with a plurality of known compositions. The preexisting spectral data associated with the plurality of known compositions may be the result of at least one of: preexisting spectral analyses of ones of the plurality of known compositions via a spectrometry portion of the downhole formation fluid sampling apparatus; and preexisting spectral analyses of ones of the plurality of known compositions via one or more spectrometry devices which are not associated with the downhole formation fluid sampling apparatus. The preexisting spectral data may be normalized by a weight fraction by compositional component of each formation fluid sample of known composition. The one or more spectrometry devices which are not associated with the downhole formation fluid sampling apparatus may comprise at least one of a spectrometry portion of apparatus positioned at the surface of a wellbore extending into a subterranean formation from which the formation fluid is flowing into the downhole formation fluid sampling, apparatus; a spectrometry portion of a second downhole formation fluid sampling apparatus positioned in the wellbore or a second wellbore extending into the subterranean formation or another subterranean formation; and a spectrometry portion of lab-based apparatus. The preexisting spectral data may comprise laboratory-obtained spectra of ones of the plurality of known compositions. The laboratory-obtained spectra may represent spectra data converted from a first number of wavelengths to a second number of wavelengths, wherein the second number is less than the first number, and wherein the second number is not greater than the number of channels of the multichannel optical sensor. The converted data may be adjusted to account for spectrometry hardware dependency and statistical noise.

The method may further comprise performing the PCA of the preexisting spectral data associated with the plurality of known compositions to determine the plurality of principal components. Performing the PCA of the preexisting spectral data associated with the plurality of known compositions to determine the plurality of principal components may comprise: vertically aligning the preexisting spectral data to a predetermined wavelength; normalizing the vertically aligned preexisting spectral data by summation over available spectral data points; and determining the plurality of principal components via PCA of the normalized, vertically aligned preexisting spectral data. Performing the PCA of the preexisting spectral data associated with the plurality of known compositions to determine the plurality of principal components may comprise: determining one or more first principal components via PCA of a first portion of the preexisting spectral data that corresponds to ones of the plurality of known compositions that have a predominant fluid type of oil; determining one or more second principal components via PCA of a second portion of the preexisting spectral data that corresponds to ones of the plurality of known compositions that have a predominant fluid type of gas; and determining one or more third principal components via PCA of a third portion of the preexisting spectral data that corresponds to ones of the plurality of known compositions that have a predominant fluid type of gas condensate. The method may further comprise vertically aligning the preexisting, spectral data to a predetermined wavelength, wherein the PCA to determine the one or more first, second and third principal components utilize the vertically aligned preexisting spectral data. The method may further comprise normalizing the vertically aligned preexisting spectral data by summation over available spectral data points, wherein performing the PCA to determine the one or more first, second and third principal components utilizes the normalized, vertically aligned preexisting spectral data.

Predicting the predominant fluid type of the formation fluid flowing through the downhole formation fluid, sampling apparatus may comprise: determining, a first score corresponding to projection of the obtained spectral data onto the one or more first principal components; determining a second score corresponding, to projection of the obtained spectral data onto the one or more second principal components: determining a third score corresponding to projection of the obtained spectral data onto the one or more third principal components; and determining the predominant fluid type based on a comparison of the first, second and third scores.

The method may further comprise adjusting an operating parameter of the downhole formation fluid sampling, apparatus based on the predicted predominant fluid type of the formation fluid flowing through the downhole formation fluid sampling apparatus. For example, the method further comprise initiating storage of a sample of the formation fluid flowing through the sampling apparatus based on the predicted predominant fluid type of the formation fluid flowing through the downhole formation fluid sampling apparatus. Alternatively, or additionally, the method may comprise adjusting a rate of pumping of formation fluid into the downhole formation fluid sampling apparatus based on the predicted predominant fluid type of the formation fluid flowing through the downhole formation fluid sampling apparatus.

Predicting the parameter of the formation fluid flowing through the downhole formation fluid sampling, apparatus based on the projection of the obtained spectral data onto the matrix that corresponds to the predominant fluid type may comprise predicting a composition of the formation fluid flowing through the downhole formation fluid sampling apparatus based on projection of the obtained spectral data onto one of a plurality of mapping matrices that each correspond to a particular fluid type. The method may further comprise estimating a gas-to-oil ratio (GOR) of the formation fluid flowing through the downhole formation fluid sampling apparatus based on the predicted composition.

The method may further comprise removing water spectra, from the obtained, spectral data before mapping the obtained spectral data to the one of the plurality of mapping matrices. The method may further comprise adjusting the obtained spectral data so that optical density at a predetermined wavelength is zero to reduce effects of scattering and refractive index of the formation fluid. The predetermined wavelength may be 1600 nm.

Each of the plurality of mapping matrices may represent a linear relationship between the preexisting spectral data and relative concentrations of predetermined compositional components of a plurality of known compositions.

Predicting the composition may comprise estimating a weight fraction of each of a plurality of components of the formation fluid flowing through the downhole formation fluid sampling apparatus. The plurality of components of the formation fluid flowing through the downhole formation fluid sampling apparatus may comprise C1, C2, (73, C4, C5, C6+ and CO2. The plurality of components of the formation fluid flowing through the downhole formation fluid sampling apparatus may consist of no more than C1, C2, C3, C4, C5, C6+ and CO2. Each of the plurality of components of the formation fluid flowing through the downhole formation fluid sampling apparatus may be selected from the group consisting of C1, C2, C3, C4, C5, C6+ and CO2.

The predominant fluid type may be one of a plurality of fluid types consisting of oil, gas and gas condensate, and the plurality of mapping matrices may consist of a first mapping matrix corresponding to compositions having a predominant fluid type of oil; a second mapping matrix corresponding to compositions having a predominant fluid type of gas; and a third mapping matrix corresponding to compositions having a predominant fluid type of was condensate.

The predominant fluid type may be one of a plurality of fluid types comprising oil, gas and was condensate, and the plurality of mapping matrices may comprise: a first mapping matrix corresponding to compositions having a predominant fluid type of oil; a second mapping matrix corresponding to compositions having a predominant fluid type of gas; and a third mapping matrix corresponding to compositions having a predominant fluid type of gas condensate. The first mapping matrix may compensate for color, and the second and third mapping matrices may not compensate for color.

Predicting the composition of the formation fluid flowing through the downhole formation fluid sampling apparatus may comprise: determining whether the predominant fluid type of the formation fluid flowing through the downhole formation fluid sampling apparatus is oil, gas or gas condensate; and projecting the obtained spectral data onto: the first mapping matrix if the determined predominant fluid type of the formation fluid flowing through the downhole formation fluid sampling apparatus is oil; the second mapping matrix if the determined predominant fluid type of the formation fluid flowing through the downhole formation fluid sampling apparatus is gas; and the third mapping matrix if the determined predominant fluid type of the formation fluid flowing through the downhole formation fluid sampling apparatus is gas condensate. Determining whether the predominant fluid type of the formation fluid flowing, through the downhole formation fluid sampling apparatus is oil, gas or gas condensate may comprise projecting the obtained spectral data onto a plurality of principal components that each correspond to predominant fluid types of oil, gas and gas condensate, respectively.

The plurality of mapping matrices may each result from partial least squares (PLS) regression analysis of preexisting spectral data associated with a plurality of known compositions. The preexisting spectral data may be normalized by a weight fraction by component of each formation fluid sample of known composition. The preexisting spectral data associated with the plurality of known compositions may be the result of at least one of: preexisting spectral analyses of ones of the plurality of known compositions via a spectrometry portion of the downhole formation fluid sampling apparatus; and preexisting spectral analyses of ones of the plurality of known compositions via one or more spectrometry devices which are not associated with the downhole formation fluid sampling apparatus. The preexisting spectral data may represent spectra data converted from a first number of wavelengths to a second number of wavelengths, wherein the second number is less than the first number, and wherein the second number is not greater than the number of channels of the multi-channel optical sensor. The converted data may be adjusted to account for spectrometry hardware dependency and statistical noise.

The method may further comprise performing the PLS regression analysis of the preexisting spectral data associated with the plurality of known compositions to determine the plurality of mapping matrices. Performing the PLS regression analysis of the preexisting spectral data associated with the plurality of known compositions to determine the plurality of mapping matrices may comprise: determining a first mapping matrix via PLS regression analysis of a first portion of the preexisting spectral data that corresponds to ones of the plurality of known compositions that have a predominant fluid type of oil; determining a second mapping matrix via PLS regression analysis of a second portion of the preexisting spectral data that corresponds to ones of the plurality of known compositions that have a predominant fluid type of gas; and determining a third mapping matrix via PLS regression analysis of a third portion of the preexisting spectral data that corresponds to ones of the plurality of known compositions that have a predominant fluid type of gas condensate. Predicting the composition of the formation fluid flowing through the downhole formation fluid sampling apparatus may comprise: determining whether the predominant fluid type of the formation fluid flowing through the downhole formation fluid sampling apparatus is oil, gas or gas condensate; and projecting the obtained spectral data onto: the first mapping matrix if the determined predominant fluid type of the formation fluid flowing through the downhole formation fluid sampling apparatus is oil; the second mapping matrix if the determined predominant fluid type of the formation fluid flowing through the downhole formation fluid sampling apparatus is gas; and the third mapping matrix if the determined predominant fluid type of the formation fluid flowing through the downhole formation fluid sampling apparatus is gas condensate. Determining whether the predominant fluid type of the formation fluid flowing through the downhole formation fluid sampling apparatus is oil, gas or gas condensate may comprise projecting the obtained spectral data onto a plurality of principal components that each correspond to predominant fluid types of oil, gas and gas condensate, respectively.

The present disclosure also introduces a system comprising: downhole means for obtaining optical spectral data associated with a formation fluid flowing through a downhole formation fluid sampling apparatus; and downhole means for predicting a parameter of the formation fluid flowing through the downhole formation fluid sampling apparatus based on projection of the obtained spectral data onto a matrix that corresponds to a predominant fluid type of the formation fluid. The downhole means for predicting the parameter of the formation fluid flowing through the downhole formation fluid sampling apparatus may comprise downhole means for predicting the predominant fluid type of the formation fluid flowing through the downhole formation fluid sampling, apparatus based on projection of the obtained spectral data onto a plurality of principal components that each correspond to a particular fluid type. The plurality of principal components may each result from principal component analysis (PCA) of preexisting spectral data associated with a plurality of known compositions. The system may further comprise means for performing the PCA of the preexisting spectral data associated with the plurality of known compositions to determine the plurality of principal components. The downhole means for predicting the parameter of the formation fluid flowing through the downhole formation fluid sampling apparatus may comprise downhole means for predicting a composition of the formation fluid flowing through the downhole formation fluid sampling apparatus based on projection of the obtained spectral data onto one of a plurality of mapping matrices that each correspond to a particular fluid type. The plurality of mapping matrices may each result from partial least squares (PLS) regression analysis of preexisting, spectral data associated with a plurality of known compositions. The system may further comprise means for performing the PLS regression analysis of the preexisting spectral data associated with the plurality of known compositions to determine the plurality of mapping matrices.

The present disclosure also introduces a computer program product comprising: a tangible medium having recorded thereon instructions for: obtaining optical spectral data associated with a formation fluid flowing through a downhole formation fluid sampling apparatus; and predicting a parameter of the formation fluid flowing through the downhole formation fluid sampling apparatus based on projection of the obtained spectral data onto a matrix that corresponds to a predominant fluid type of the formation fluid. The instructions for predicting the parameter of the formation fluid flowing through the downhole formation fluid sampling apparatus may comprise instructions for predicting the predominant fluid type of the formation fluid flowing through the downhole formation fluid sampling apparatus based on projection of the obtained spectral data onto a plurality of principal components that each correspond to a particular fluid type. The plurality of principal components may each result from principal component analysis (PCA) of preexisting spectral data associated with a plurality of known compositions. The instructions recorded on the tangible medium may include instructions for performing the PCA of the preexisting spectral data associated with the plurality of known compositions to determine the plurality of principal components. The instructions for predicting the parameter of the formation fluid flowing through the downhole formation fluid sampling apparatus may comprise instructions for predicting a composition of the formation fluid flowing through the downhole formation fluid sampling apparatus based on projection of the obtained spectral data onto one of a plurality of mapping matrices that each correspond to a particular fluid type. The plurality of mapping matrices may each result from partial least squares (PLS) regression analysis of preexisting spectral data associated with a plurality of known compositions. The instructions recorded on the tangible medium may include instructions for performing the PLS regression analysis of the preexisting spectral data associated with the plurality of known compositions to determine the plurality of mapping matrices.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

obtaining in-situ optical spectral data associated with a formation fluid flowing through a downhole formation fluid sampling apparatus;

predicting a parameter of the formation fluid flowing through the downhole formation fluid sampling apparatus using a processing system based on projection of the obtained spectral data onto a matrix in the processing system that corresponds to a predominant fluid type of the formation fluid; and adjusting an operating parameter of the downhole formation fluid sampling apparatus based on the predicted parameter.

2. The method of claim 1 wherein the spectral data associated with the formation fluid flowing through the downhole formation fluid sampling apparatus is obtained at least in part via a multi-channel optical sensor of the downhole formation fluid sampling apparatus, wherein the multi-channel optical sensor of the downhole formation fluid sampling apparatus comprises at least one spectrometer.

3. The method of claim 1 wherein adjusting an operating parameter of the downhole formation fluid sampling apparatus based on the predicted parameter comprises at least one of:

initiating storage of a sample of the formation fluid flowing through the downhole formation fluid sampling apparatus based on the predicted parameter; and adjusting a rate of pumping of formation fluid into the downhole formation fluid sampling apparatus based on the predicted parameter.

4. The method of claim 1 further comprising conveying the downhole formation fluid sampling apparatus within a wellbore extending into the formation, wherein the conveying is via at least one of wireline and a string of tubulars.

5. A method, comprising:

obtaining in-situ optical spectral data associated with a formation fluid flowing through a downhole formation fluid sampling apparatus;

predicting a parameter of the formation fluid flowing through the downhole formation fluid sampling apparatus using a processing system based on projection of the obtained spectral data onto a matrix in the processing system that corresponds to a predominant fluid type of the formation fluid; and adjusting an operating parameter of the downhole formation fluid sampling apparatus based on the predicted parameter;

wherein predicting the parameter of the formation fluid comprises predicting the predominant fluid type of the formation fluid flowing through the downhole formation fluid sampling apparatus based on projection of the obtained spectral data onto a plurality of principal components that each correspond to a particular fluid type.

6. The method of claim 5 further comprising adjusting the obtained spectral data using the processing system before projecting the obtained spectral data onto the plurality of principal components, wherein adjusting comprises at least one of:

removing water spectra from the obtained spectral data;

reducing effects of formation fluid scattering and refractive index differences by forcing optical density at a predetermined wavelength to zero; and removing color effects from the obtained spectral data.

7. The method of claim 5 wherein:

the plurality of principal components comprises:

one or more first principal components corresponding to ones of a plurality of known compositions having a predominant fluid type of oil;

one or more second principal components corresponding to ones of the plurality of known compositions having a predominant fluid type of gas; and one or more third principal components corresponding to ones of the plurality of known compositions having a predominant fluid type of gas condensate; and predicting the predominant fluid type of the formation fluid flowing through the downhole formation fluid sampling apparatus comprises:

determining a first score corresponding to projection of the obtained spectral data onto the one or more first principal components;

determining a second score corresponding to projection of the obtained spectral data onto the one or more second principal components;

determining a third score corresponding to projection of the obtained spectral data onto the one or more third principal components; and determining the predominant fluid type based on a comparison of the first, second and third scores.

8. The method of claim 5 wherein the plurality of principal components each result from principal component analysis (PCA) of preexisting spectral data associated with a plurality of known compositions.

9. The method of claim 8 wherein the preexisting spectral data comprises laboratory-obtained spectra of ones of the plurality of known compositions, wherein the laboratory-obtained spectra represents spectra data converted from a first number of wavelengths to a second number of wavelengths, wherein the second number is less than the first number, and wherein the second number is not greater than the number of channels of the multi-channel optical sensor.

10. The method of claim 8 further comprising performing the PCA of the preexisting spectral data associated with the plurality of known compositions to determine the plurality of principal components.

11. The method of claim 10 wherein performing the PCA of the preexisting spectral data associated with the plurality of known compositions to determine the plurality of principal components comprises:

vertically aligning the preexisting spectral data to a predetermined wavelength;

normalizing the vertically aligned preexisting spectral data by summation over available spectral data points; and determining the plurality of principal components via PCA of the normalized, vertically aligned preexisting spectral data.

12. The method of claim 10 wherein:

performing the PCA of the preexisting spectral data associated with the plurality of known compositions to determine the plurality of principal components comprises:

determining one or more first principal components via PCA of a first portion of the preexisting spectral data that corresponds to ones of the plurality of known compositions that have a predominant fluid type of oil;

determining one or more second principal components via PCA of a second portion of the preexisting spectral data that corresponds to ones of the plurality of known compositions that have a predominant fluid type of gas; and determining one or more third principal components via PCA of a third portion of the preexisting spectral data that corresponds to ones of the plurality of known compositions that have a predominant fluid type of gas condensate; and predicting the predominant fluid type of the formation fluid flowing through the downhole formation fluid sampling apparatus comprises:

determining a first score corresponding to projection of the obtained spectral data onto the one or more first principal components;

determining a second score corresponding to projection of the obtained spectral data onto the one or more second principal components;

determining a third score corresponding to projection of the obtained spectral data onto the one or more third principal components; and determining the predominant fluid type based on a comparison of the first, second and third scores.

13. A method, comprising:

obtaining in-situ optical spectral data associated with a formation fluid flowing through a downhole formation fluid sampling apparatus;

predicting a parameter of the formation fluid flowing through the downhole formation fluid sampling apparatus using a processing system of the downhole formation fluid sampling apparatus based on projection of the obtained spectral data onto a matrix in the processing system that corresponds to a predominant fluid type of the formation fluid; and adjusting an operating parameter of the downhole formation fluid sampling apparatus based on the predicted parameter;

wherein predicting the parameter of the formation fluid comprises predicting a composition of the formation fluid flowing through the downhole formation fluid sampling apparatus based on projection of the obtained spectral data onto one of a plurality of mapping matrices that each correspond to a particular fluid type.

14. The method of claim 13 further comprising estimating in the processing system a gas-to-oil ratio (GOR) of the formation fluid flowing through the downhole formation fluid sampling apparatus based on the predicted composition.

15. The method of claim 13 wherein each of the plurality of mapping matrices represents a linear relationship between the preexisting spectral data and relative concentrations of predetermined compositional components of a plurality of known compositions.

16. The method of claim 13 wherein:

the predominant fluid type is one of a plurality of fluid types comprises oil, gas and gas condensate;

the plurality of mapping matrices comprises:

a first mapping matrix corresponding to compositions having a predominant fluid type of oil;

a second mapping matrix corresponding to compositions having a predominant fluid type of gas; and a third mapping matrix corresponding to compositions having a predominant fluid type of gas condensate; and predicting the composition of the formation fluid flowing through the downhole formation fluid sampling apparatus comprises determining in the processing system whether the predominant fluid type of the formation fluid flowing through the downhole formation fluid sampling apparatus is oil, gas or gas condensate and projecting the obtained spectral data onto:

the first mapping matrix if the determined predominant fluid type of the formation fluid flowing through the downhole formation fluid sampling apparatus is oil;

the second mapping matrix if the determined predominant fluid type of the formation fluid flowing through the downhole formation fluid sampling apparatus is gas; and the third mapping matrix if the determined predominant fluid type of the formation fluid flowing through the downhole formation fluid sampling apparatus is gas condensate.

17. The method of claim 16 wherein determining whether the predominant fluid type of the formation fluid flowing through the downhole formation fluid sampling apparatus is oil, gas or gas condensate comprises projecting the obtained spectral data onto a plurality of principal components that each correspond to predominant fluid types of oil, gas and gas condensate, respectively.

18. The method of claim 13 wherein the plurality of mapping matrices each result from partial least squares (PLS) regression analysis of preexisting spectral data associated with a plurality of known compositions.

19. The method of claim 18 further comprising performing the PLS regression analysis of the preexisting spectral data associated with the plurality of known compositions to determine the plurality of mapping matrices, wherein performing the PLS regression analysis of the preexisting spectral data associated with the plurality of known compositions to determine the plurality of mapping matrices comprises:

determining a first mapping matrix via PLS regression analysis of a first portion of the preexisting spectral data that corresponds to ones of the plurality of known compositions that have a predominant fluid type of oil;

determining a second mapping matrix via PLS regression analysis of a second portion of the preexisting spectral data that corresponds to ones of the plurality of known compositions that have a predominant fluid type of gas; and determining a third mapping matrix via PLS regression analysis of a third portion of the preexisting spectral data that corresponds to ones of the plurality of known compositions that have a predominant fluid type of gas condensate.

20. The method of claim 13, wherein adjusting an operating parameter of the downhole formation fluid sampling apparatus based on the predicted parameter comprises:

initiating storage of a sample of the formation fluid flowing through the downhole formation fluid sampling apparatus based on the predicted parameter; or adjusting a rate of pumping of formation fluid into the downhole formation fluid sampling apparatus based on the predicted parameter; or a combination thereof.

* * * * *